United States Patent [19]

Perkins et al.

[11] Patent Number: 4,981,173

[45] Date of Patent: Jan. 1, 1991

[54] ELECTRIC SURFACE CONTROLLED SUBSURFACE VALVE SYSTEM

[75] Inventors: Donald H. Perkins, Carrollton; Thomas M. Deaton, Farmers Branch, both of Tex.

[73] Assignee: Otis Engineering Corporation, Dallas, Tex.

[21] Appl. No.: 365,701

[22] Filed: Jun. 14, 1989

Related U.S. Application Data

[63] Continuation-in-part of Ser. No. 169,814, Mar. 18, 1988.

[51] Int. Cl.[5] ..... E21B 34/00

[52] U.S. Cl. ..... 166/66.4; 166/66.5; 166/332; 251/129.09; 251/129.15

[58] Field of Search ..... 166/246, 65.1, 66.4, 166/66.5, 332; 439/193; 251/129.04, 129.09, 129.15, 129.18; 137/418, 521.

[56] References Cited

U.S. PATENT DOCUMENTS

| | | | |
|---|---|---|---|
| 3,196,948 | 7/1965 | Dye | 166/66.4 |
| 4,191,248 | 3/1980 | Huebsch et al. | 166/65.1 |
| 4,579,177 | 4/1986 | Going, III | 166/332 |
| 4,667,736 | 5/1987 | Rumbaugh et al. | 166/65.1 |
| 4,725,783 | 2/1988 | Miyairi et al. | 324/347 |
| 4,796,708 | 1/1989 | Lembcke | 166/386 |

*Primary Examiner*—William P. Neuder
*Attorney, Agent, or Firm*—Johnson & Gibbs

[57] ABSTRACT

A solenoid operated valve system for petroleum production wells including a solenoid operated valve securable in a well bore connected to the lower end of a tubing string extending to the surface. The valve of the system includes an outer housing, an inner wall defining a flow passageawy therethrough and an annular cavity therebetween for receiving the solenoid coil and associated electrical components. The spaces in the annular cavity surrounding the solenoid coil and components is filled with an electrically insulative filler material to protect the electrical elements from borehole fluids. The solenoid operated valve has an operator tube formed of tubular sections of different magnetic characteristics so that the valve is opened against a biasing spring by a high current flow and held open by a current flow of a lower value. The valve solenoid is operable by either AC or DC current.

28 Claims, 7 Drawing Sheets

ELECTRIC SURFACE CONTROLLED SUBSURFACE VALVE SYSTEM

CROSS REFERENCE TO RELATED APPLICATIONS

This is a continuation-in-part of patent application Ser. No. 169,814 filed Mar. 18, 1988 now U.S. Pat. No. 4,886,114 entitled Electric Surface Controlled Subsurface Valve System.

BACKGROUND OF THE INVENTION

1. Field of the Invention

The invention relates to solenoid operated valves for petroleum production wells and, more particularly, to a structural and power supply arrangement for an electrical solenoid operated safety valve system.

2. History of the Prior Art

Oil and gas wells, and in particular those located off-shore, are frequently subject to wellhead damage which may be produced by violent storms, collisions with ships and numerous other disastrous occurrences. Damage to the wellhead may result in the leakage of hydrocarbons into the atmosphere producing the possibility of both the spillage of the petroleum products into the environment as well as an explosion and fire resulting therefrom. In addition to off-shore production wells, another environment in which damage to a wellhead may have disastrous effects is that of producing wells located in urban areas. Moreover, in such urban production wells, it is generally a specific legal requirement that there be some downhole means of terminating the flow of petroleum products from the well in the event of damage to the well head. In such instances, the safety valve system must be responsive to a dramatic increase in flow rate from the well so as to close down and terminate production flow from the well. For these reasons, sub-surface safety valves located downhole within a borehole have long been included as an integral part of the operating equipment of a petroleum production well.

Various types of petroleum production flow safety valve systems have been provided in the prior art. Each system includes a valve means for controlling the flow of petroleum products up the tubing from a point down in the borehole from the wellhead. Safety valve systems also include sensing means which are responsive to wellhead damage, a dramatic increase in production flow, or some other emergency condition requiring that the flow from the well be terminated by the valve.

One type of operating mechanism used to actuate a safety valve within a well includes an electrical solenoid employed to hold the safety valve in an open condition and a spring means to return it to a normally closed condition in response to interruption in the flow of current to the solenoid. Numerous such systems have been proposed, for example, U.S. Pat. No. 4,002,202 to Huebsch et al, U.S. Pat. No. 4,161,215 to Bourne, Jr. et al, and U.S. Pat. No. 4,566,534 to Going III. Each of these systems provide a solenoid actuated operating mechanism for the safety valve which is responsive to a DC electric current supplied from surface equipment. Such solenoids generally require a fairly high level surge of initial operating current to cause the solenoid to operate and change states and then a smaller level of current to hold the solenoid in its operated condition. These large actuating current surges require heavy electrical conductors in order to carry such current downhole for any substantial distance and still maintain a voltage level sufficient to operate the solenoid. Moreover, such solenoids are usually supplied with current from a conventional power supply at the surface which produces a fixed voltage output signal. This limits the depth to which the solenoid can be used and still operate with a particular power supply configuration. Use of the same solenoid actuated safety valve in deeper wells requires a change in the power supply circuit in order to supply sufficient current to operate it.

Prior art solenoid actuated safety valve systems have also dealt with the design constraints of high downhole pressures and corrosive borehole fluid in a relatively conventional manner. For example, large values of downhole pressure have required that the pressure resisting walls of the parts of the valve isolating the coil from well pressure be relatively thick in order to serve as a load bearing member of the valve assembly and protect the valve components inside. Thick walls both increase the diameter of the overall valve structure for a given pressure rating as well as limit the thickness of the magnetic armature of the valve and, hence, restricts its magnetic responsiveness to a given value of solenoid actuation current. Similarly, prior art solenoid actuated safety valves have also relied upon the precise machining of valve parts and the presence of high pressure resilient seals, such as O-rings, in order to protect the internal electrical components of the valve, such as the solenoid coil, from borehole fluids. Such fluid sealing components increase the cost of the safety valve and are subject to failure under use. The structure and construction techniques of the valve systems of the present invention overcome many of these disadvantages of prior solenoid actuated safety valve systems.

The inherent disadvantages of providing several different power supply circuits for different depths of operation of a solenoid actuated safety valve is obviated by the system of the present invention which provides means for coupling a constant value of current from the surface down the electrically conductive path interconnecting that current to the windings of a solenoid actuated safety valve. The system provides an optimum value of current for actuation of the solenoid and control of the safety valve regardless of the voltage required to deliver that current to the solenoid at the particular depth of the safety valve. In addition, the solenoid actuated safety valve of the present invention also allows construction of a less expensive and more reliable valve which is of a smaller overall diameter for a particular pressure rating of the valve. In addition, the safety of the present invention is more magnetically responsive for a given valve of operating current delivered to the solenoid coil.

The system of the present invention overcomes many of the disadvantages of the prior art electrically operated solenoid actuated safety valve systems.

SUMMARY OF THE INVENTION

In one aspect, the present invention includes an electrically operated solenoid actuated safety valve system for use in a borehole. An elongate tubular safety valve housing assembly has one end adapted for attachment to the lower end of a tubing string within the borehole and the other end adapted to control the entry of borehole fluids into the assembly. The housing assembly includes an outer housing, an inner wall defining a tubular passageway for allowing fluid flow through the valve assembly, and an annular space between the two. A tubular magnetic armature is mounted for axial movement within the tubular passageway through the valve assembly from a spring biased upper retracted, valve closed position to a lower extended position opening the valve. A tubular electrical solenoid coil is positioned in the annular space between the outer housing and the inner wall of said housing assembly and, is located at an axial position below the upper retracted position of the armature. The opposite ends of the wire coil of the solenoid extend through the annular space toward the end of the housing assembly adapted to be connected to the tubing. An electrical cable extends from the surface of the borehole and is connected to the solenoid wire ends to enable current to flow through the solenoid coil and cause movement of the tubular armature of the valve toward its lower extended position and effect opening of the valve. An electrically insulative filler material fills substantially all regions of the annular space not occupied by the solenoid and wires to prevent the entry of borehole fluids into the annular space.

In another aspect the present invention includes an electric solenoid actuated valve system for use in a petroleum production well having fluid production tubing extending down a borehole. An elongate housing assembly has a central passageway and an annular cavity located between the outside wall of said housing and the inside wall defining the passageway. The upper end of the housing is connected to the lower end of the tubing for fluid communication between the tubing and the passageway. A normal closed valve flapper is mounted to the lower end of the elongate housing and extends across the lower end of the passageway to prevent the flow of fluids from within the borehole into the passageway. A solenoid energization coil is mounted within the annular cavity located in the sidewalls of said elongate housing and surrounding the passageway. An elongate operator tube is formed of magnetic material coaxially mounted for limited longitudinal movement in the downward direction within the passageway through the housing in response to magnetic forces produced by the solenoid coil. The operator tube has a longitudinal opening to permit the flow of fluids therethrough and has the lower end thereof positioned adjacent the normally closed valve flapper to open the valve upon downward movement of the operator tube. The ends of the wire coil forming the solenoid energization coil are connected to a source of electrical potential to complete the electrical circuit for energizing the solenoid coil and moving the operator tube in the downward direction to open and the valve. An electrically insulative filler material surrounds the solenoid coil and fills the open space within the annular cavity located in the sidewalls of the housing to insulate the electrical components of the solenoid coil from borehole fluids.

In a still further aspect, the present invention also includes a control system for applying power to a solenoid operated valve in a well completion within a borehole in which a programmable power supply is mounted within a surface control unit for selectively applying electric power at a first selected higher current value and a second selected lower current value to a cable connected to supply operating current to the solenoid coil of the valve. The valve includes means responsive to the first higher value of current for changing the state of the solenoid and responsive to the second lower value of current for maintaining the state of the safety valve and responsive to interruption of all current for closing the safety valve. The surface monitoring and control unit includes means for continuously monitoring the state of actuation of the safety valve and providing an indication thereof at the well surface.

In a still further aspect, the present invention encompasses a control system for applying power to a solenoid operated valve in a well completion within a borehole. A surface control unit selectively produces a programmable value of voltage and an electrical cable connects the voltage produced to a solenoid valve located downhole. In the circuit with the electrical cable there is a means for measuring the value of electric current flowing from the voltage producing means to the solenoid valve. In the tubing and responsive to a selected value of electric current there is means for changing the state of the solenoid and opening the safety valve and interrupting the electric current for closing the safety valve. The surface control unit is responsive to the electric current value measuring means for varying the value of voltage produced by the programmable voltage producing means to produce a selected value of electric current to the solenoid.

One additional aspect of the invention includes a method of manufacturing an electrically operated solenoid actuated safety valve in which an elongate tubular safety valve housing assembly is provided which includes an outer housing, an inner wall defining a tubular passageway for allowing fluid flow through the valve assembly, and an annular space therebetween. A tubular magnetic armature is mounted for axial movement within the tubular passageway through the valve assembly and the tubular armature is spring biased toward an upper retracted position and away from a lower extended position opening the valve for fluid flow through the tubular passageway. A tubular electrical solenoid coil is positioned in the annular space between the outer housing and the inner wall of the housing assembly and surrounding the tubular passageway and the annular space is filled in substantially all regions not occupied with the solenoid coil with an electrically insulative filler material to prevent the entry of borehole fluids into the annular space of the valve when it is subsequently placed in use within a borehole.

BRIEF DESCRIPTION OF THE DRAWING

For an understanding of the present invention and for further objects and advantages thereof, reference can now be had to the following description taken in conjunction with the accompanying drawing in which.

DETAIL DESCRIPTION OF THE PREFERRED EMBODIMENT

Figure 1:
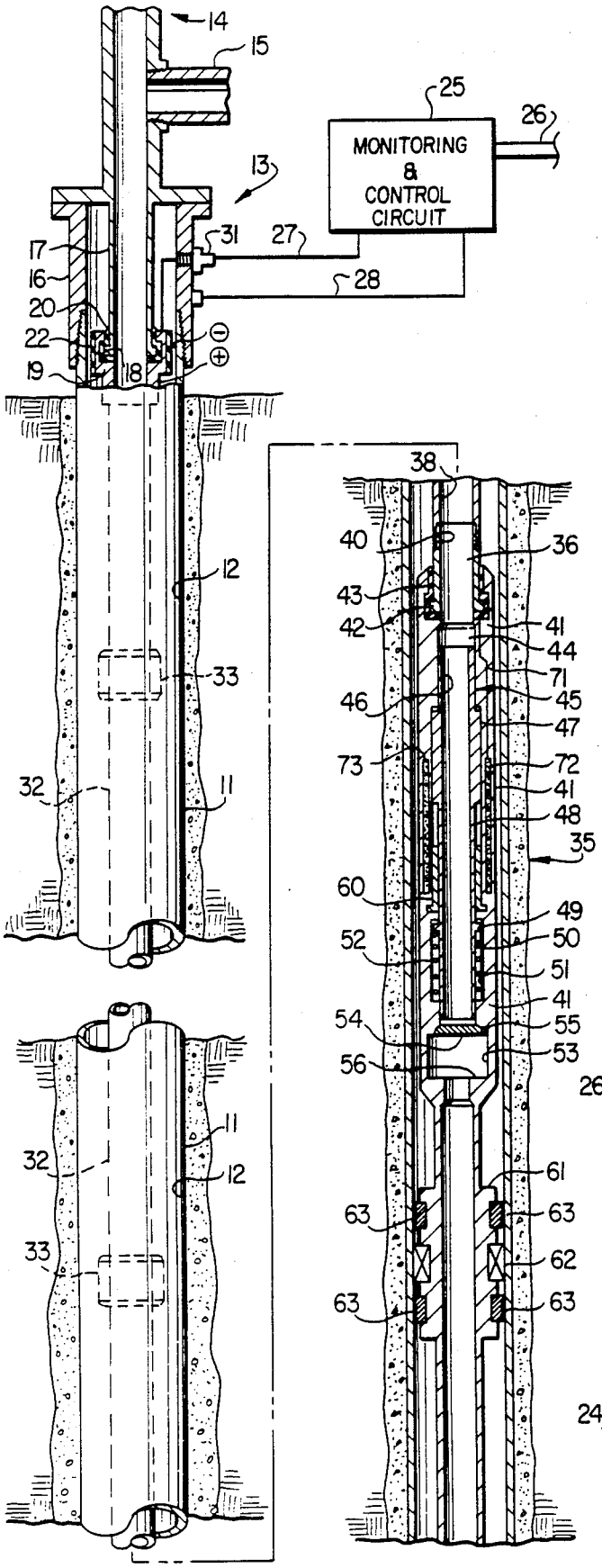
FIG. 1 is a schematic drawing of a well completion including an illustrative cross-sectional view of one embodiment of an electrically operated solenoid actuated safety valve system which is related to that which is constructed in accordance with the teachings of the present invention.

Referring first to FIG. 1, there is shown a schematic cross-sectional illustration of one embodiment of a well completion incorporating a related embodiment of the electrically operated solenoid actuated safety valve system of the present invention. This embodiment is set forth and claimed in U.S. Patent application Ser. No. 169,814 filed Mar. 18, 1988, the parent of the present application. In that application, the principal emphasis was on the manner in which current was delivered to the valve for actuation of the solenoid. However, it will be discussed here because of the relationship between the valve structure shown in that embodiment and the preferred embodiment of the present invention discussed below.

Referring to FIG. 1, a casing 11 is positioned along the borehole 12 formed in the earth and extending from a wellhead 13 located at the surface down into the petroleum producing geological formation. The wellhead 13 includes a typical Christmas tree production flow control configuration 14 having an output line 15 leading to storage facilities (not shown) for receiving production flow from the well. A wellhead support flange 16 is formed of conventional conductive metal material and is mechanically and electrically connected to the casing 11 extending down the borehole 12. A tubular production conduit 17 extends from the output line 15 co-axially through the wellhead support flange 16 and includes an outwardly flared radially extending flange region 18 at its lower end. The flange region 18 of the production conduit 17 extends into and is physically coupled with open end of a tubing head 19 but is electrically insulated therefrom by an electrically insulative shield 20 which surrounds the radially flared flange 18 to mechanically connect it to the tubing head 19 but electrically insulate it. The cylindrical outer periphery of the tubing head 19 is also covered with electrically insulative material 22 so that in the event there is mechanical contact between the outer walls of the insulator 22 and the inner walls of the casing 11 no electrical conduction will take place.

A wellhead monitoring and control circuit 25 is connected to a source of AC electric current by means of a cable 26 and includes means for rectifying current from that source and producing a positive DC voltage on a first power cable 27 and a negative DC voltage on a second power cable 28. The negative potential on the second cable 28 is electrically connected to the wellhead support flange 16 which is, of course, electrically connected to the casing 11 and the earth potential of the borehole. The positive potential on the first cable 27 passes through an insulator 31 extending through the sidewalls of the wellhead support flange 16 and is electrically connected to the upper end of the tubing head 19 which is electrically insulated from both the wellhead support flange 16, by means of the insulator 22, and from the tubular production conduit 17 by means of the insulator 20.

The tubing head 19 is mechanically and electrically connected in conventional fashion to additional elongate sections of tubing 32 which extend coaxially down the casing 11. Insulative tubing centralizers 33 are longitudinally spaced from one another along the tubing 32 to support the tubing near the central axis of the casing 11 and to prevent any electrically conductive contact therewith.

At the lower end of the tubing 32 there is positioned a solenoid safety valve assembly 35 which is coupled to the lower end of the tubing by means of an assembly support flange 36 which threadedly engages the lower end of the tubing 32. The safety valve assembly includes an elongate housing 41 formed of a conventional electrically conductive magnetic material having a generally cylindrical outer configuration and recesses formed therein for receiving the components of the solenoid operated safety valve. The assembly support flange 36 includes a threaded tubular upper end 40 and a lower end having a radially extending flange portion 42 which is mechanically attached to but electrically insulated from the inner walls of the housing 41 by means of an electrically insulative upper adaptor 43. The adaptor 43 electrically isolates the positive electrical potential on the tubing 32 from the negative potential of the housing 41. The housing 41 includes an axially extending central bore 44 for receiving an operator tube 45 adapted for axial movement therein. The operator tube 45 may preferably be formed of several cylindrical sections of different thickness and mass as well as of materials having different magnetic permeability. At the upper end of the operator tube 45 there is a relatively thin walled upper section 46 formed of relatively less magnetic material, such as 9CR-1MOLY steel. An intermediate armature portion 47 is constructed of a highly magnetic material such as 1018 low carbon alloy steel and forms a central portion of the operator tube 45 while an elongate thin walled lower section 48 is formed of the less magnetic material such as 9CR-1MOLY steel. The bottom section 50 located at the lower end of the operator tube 45 is also of relatively less magnetic material and includes a radially extending circumferential flange member 49 which is received within a radially extending cavity 51 formed in the inner walls of the housing 41. A helical spring 52 surrounds the lower end 48 of the operator tube 45 and normally biases the tube in the upward direction by a force exerted against the circumferential flange 49.

A lower cavity 53 in the housing 41 receives a valve flapper member 54 which is pivotally mounted to the sidewall of the housing 41 by a hinge 55 which is spring biased toward the closed position, as shown. A sufficient force against the upper side of the valve flapper 54 will cause it to pivot about the hinge 55 and move into the side walls of the cavity 53 thereby opening the interior axial passageway 44 through the housing 41 to allow the flow of borehole fluids lower down in the borehole up the tubing to the wellhead. The lower end of housing 41 is mechanically and electrically connected to well packer 61 by an additional portion of production conduit 17 therebetween. Packer 61 include radially extending seal elements 62 which form a fluid barrier with the inside wall of casing 11. Packer 61 direct the flow of well fluids between wellhead 13 and a downhole formation (not shown) via production conduit 17 and safety valve 35. Slips 63 carried by packer 61 form a series of toothed engagements with the inside wall of casing 11 to anchor packer 61 at a selected downhole location. Slips 63 mechanically and electrically engage packer 61 with casing 11 to form a positive electrical contact between casing 11 and housing 41 of safety valve assembly 35. If desired, one or more conventional tubing centralizers (not shown) with bow springs or other contacting means could be installed in the portion of production conduit 17 between safety valve 35 and well packer 61. The bow springs on such centralizers can provide additional electrical contact with casing 11.

The assembly support flange 36 is electrically connected to a conductive cable 71 which extends through an opening in the insulative upper adaptor 43 down through a passageway formed in the side wall of the casing 41 to electrically connect with one end of an electrical solenoid 72 in a cavity formed in the inner side walls of the housing 41. The solenoid coil 72 comprises a plurality of helically wound turns of a conductor. The other end of the winding of the solenoid coil 72 is electrically connected to the body of the housing 41 by means of a set screw 73 to thereby indirectly form an electrical connection with the casing 11.

The coil 72 is positioned within the body of the housing 41 so that the highly magnetic armature portion 47 of the operator tube 45 is located near the upper ends of the coil 72 when there is no current flow through the coil and the tube 45 is in its upwardly spring biased position. A cylindrical magnetic stop 60 is positioned within the central bore 44 near the lower end of the solenoid coil 72 so that the lower portion 48 of the operator tube 45 is axially movable there through. A mechanical stop 56 is formed on the lower inside edges of the cavity 53 to limit the extent of the downward movement by the operator tube 45. When the lower edge of bottom section 50 of the operator tube 45 abuts the mechanical stop 56, the lower edge of the armature portion 47 is spaced by a small but distinct air gap from the upper edges of the magnetic stop 60. The highly magnetic stop 60 creates a low reluctance path for magnetic flux generated by the solenoid coil 72 so that the armature 47 of the operator tube can be held adjacent thereto by a relatively low value of current flow through the coil 72. The air gap, for example on the order of 0.050 inch, is provided to insure that the operator tube 45 will return to its upper position in response to the force generated by the bias spring 52 when current is removed from the coil 72 and not be retained in its lower position by residual magnetism due to physical contact between the operator tube 45 and the magnetic stop 60.

When an actuator current of a first value flows through the winding of the solenoid coil 72 the magnetic flux generated thereby causes the armature 47 to move downwardly toward the center of the coil 72. As the lower edges of the operator tube 45 move downwardly toward the mechanical stop 56, they cause the spring biased flapper 54 to pivot about hinge 56 into the cavity 53 to open the safety valve and allow production fluids to flow up the tubing to the wellhead. When the operator tube moves to its lower actuated position the helical spring 52 is compressed by the circumferential flange 49. Once the armature 47 has been moved to the lower position by a relatively high value of magnetic flux produced by a relatively high value of actuation current through the solenoid coil 72, the lower edge of the armature is closely spaced from the magnetic stop 60. Thereafter, a relatively lower value of magnetic flux generated by a relatively lower value of holding current through the coil 72 will retain the operator tube 45 in its lower, actuated position and the valve flapper 54 in the open condition. Removal of all current from the coil 72 allows the spring 52 to move the operator tube 45 to its upper position which allows the spring biased hinge 52 to close the flapper 54 and, thus, the safety valve to the flow of any borehole fluids up the tubing 32 to the wellhead.

The power to actuate and hold open the safety valve comes from the monitor and control circuit 25 at the wellhead 13 by means of the conductive tubing and casing of the well completion. DC electric current from the cable 27 is coupled through the conductive tubing head 19 down the length of tubing 32 into the valve assembly support flange 36. The flange 36 is connected to the electrical conductor 71, one end of the windings of the solenoid coil 72, through the coil 72 and out the other end to the connector 73 and the conductive body of the housing 41. The housing 41 is electrically connected through the conductive slip 61 to the conductive casing 11 and back to the negative cable conductor 28 which returns to the monitoring and control circuit 25. Thus, electrical current is coupled from the wellhead down the tubing and casing of the borehole production assembly and is used to operate the solenoid of the safety valve assembly. The system of the invention contemplates a periodic reversing of the polarity of the DC current from the monitoring and control circuit 25 located at the wellhead, for example on a weekly or monthly basis. This would serve to minimize the effects of downhole galvanic corrosion within the system.

It can be seen from FIG. 1 that the application of electric current from the wellhead down the electrically conductive tubing and casing to the solenoid coil 72 will pull the armature 47 of the operating tube 45 in a downward direction against the bias of the spring 52 to press against the flapper door 54 and cause it to pivot about its spring biased 55 into the cavity 53 against the inner side wall of the housing. The operator tube 45 moves downwardly until the lower edges of the tube abut the mechanical stop at the upper edges 56 of the cavity 53. In addition, the lower edges of the armature portion 47 of the operator tube 45 closely approach but are physically separated from the upper edges of the magnetic stop 60. The magnetic stop 60 completes a low reluctance magnetic circuit from the solenoid coil through the armature 47 to allow the armature to be held in the lower position by means of a lower valve of magnetic flux, and hence a lower holding current through the solenoid than is necessary to cause the operator tube 45 to move downwardly in the first instance. The upper edges of the magnetic stop 60 are physically spaced from the lower edges of the armature 47 by means of an air gap.

As can be seen, the system shown in FIG. 1 illustrates the manner in which the conductive tubing and casing of a relatively conventional well completion are used to deliver operating current to the solenoid operated safety valve within the valve assembly, thus, eliminating the necessity for heavy electrical cables extending down the well along with the tubing. In addition, the conductive pathway of the tubing and casing of the production completion also allow monitoring of the operated state of the valve as will be further explained in connection with the discussion of the figures below.

It should be noted that although the embodiment of the system shown in FIG. 1 is used with solenoid operated safety valves, the system can also be used to provide operating power and control to other types of solenoid operated valves such as a solenoid operated gas lift valve as shown in U.S. Pat. No. 3,427,989. It should also be understood that although DC current and solenoids are preferred, AC solenoids could also be used in certain embodiments of the system of the invention.

In one embodiment of the system shown in FIG. 1, it is preferable to run relatively less electrically conductive borehole fluids into the annular space between the tubing and the solenoid operated safety valve assembly and the conductive wall of the casing to ensure as high a level of insulation as possible between the two electrical elements of opposite potential. That is, borehole fluids such as kerosene or oil based muds and other less electrically conductive types of annular fluids create a less conductive shorting element and, thus, a more conductive environment to the operation of the system of the present invention. On annulus fluid having low conductivity satisfactory for use is oil external emulsion completion fluid, such as HLX-W230 with calcium chloride as an internal aqueous phase. The fluid density was 11.6 lbs./gal. HLX-W230 is available from Halliburton Services, Drawer 1431, Duncan, OK 73536. Of course, the deeper the borehole location of the safety valve assembly, the more important is the low conductivity of the annular borehole fluid. In shallow wells even a relatively more conductive fluid may not have a significant shorting effect on current flow through the well tubing and casing.

Figure 2:
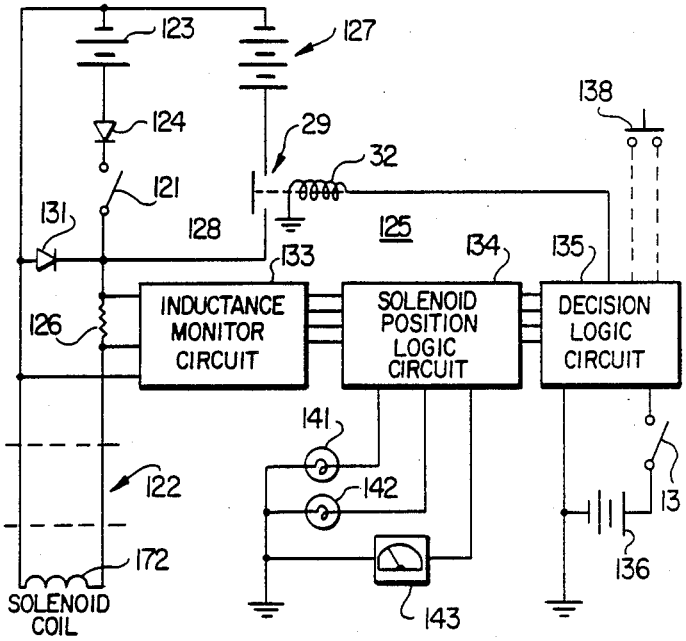
FIG. 2 is a schematic diagram of the electrical circuitry of one embodiment of the electrically operated solenoid actuated safety valve system of the present invention.
Figure 3B:
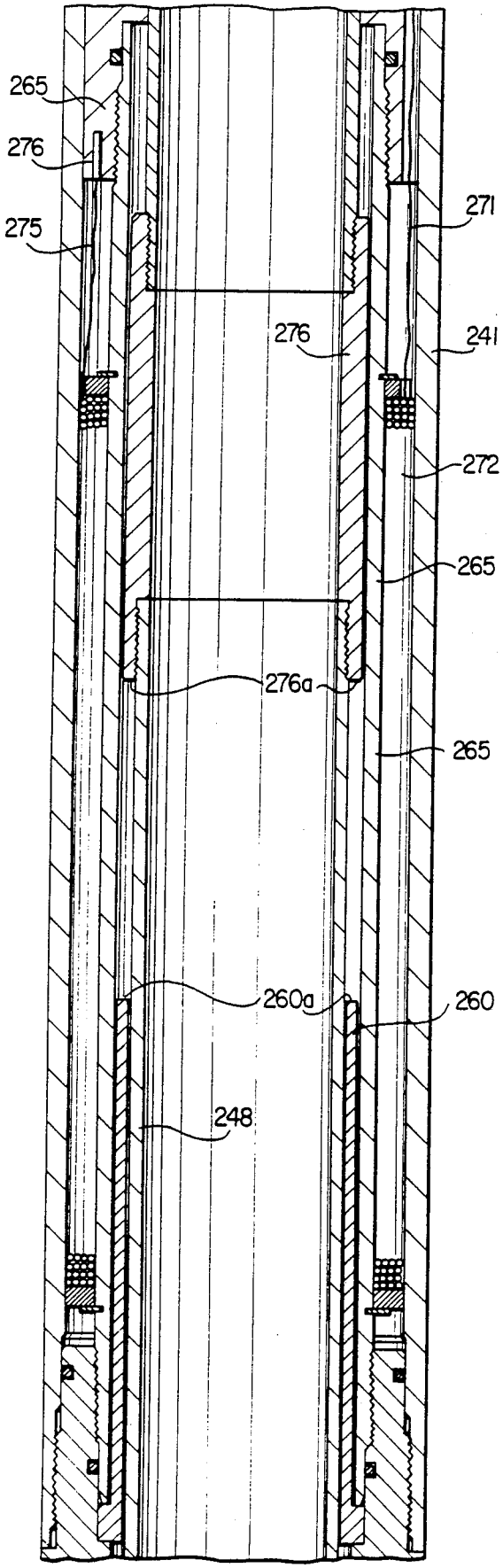
Figure 3C:
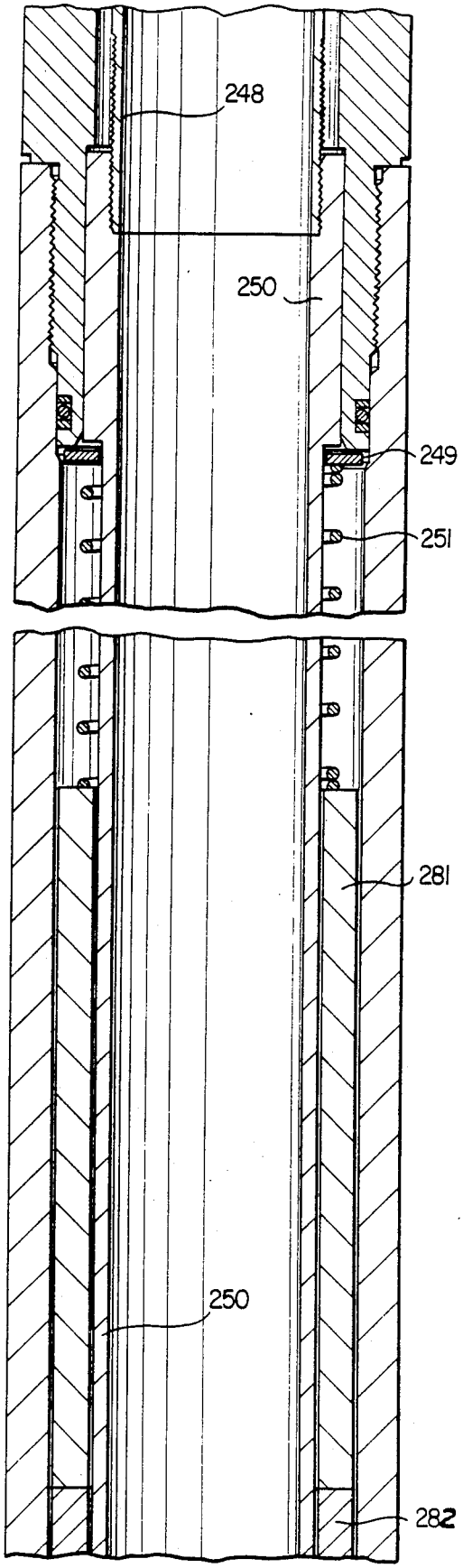

Referring next to FIG. 2, there is shown a schematic drawing of one embodiment of a circuit for operating and monitoring the condition of a solenoid actuated safety in accordance with the system of the present invention. The circuit has the capability of actuating the solenoid operated valve from a closed to an open position by the application of a relatively high value of DC current to change the state of the solenoid and then holding the valve in the open position by applying a relatively lower value to the solenoid. Removal of all electrical power to the solenoid controlling the valve allows a spring-biased closure member incorporated in the valve to close the valve as discussed above.

The position (open or closed) of the safety valve 35 is important to the well operator. When valve 35 is closed, armature 47 is spaced longitudinally away from solenoid coil 72. In this position, inductance should be relatively low. There is a large opening in the solenoid coil (low permeability). It should be noted that DC current is not limited by the inductance of solenoid coil 72, only resistance of the wires limits DC current.

When valve 35 is in its open position, armature 47 is radially adjacent to coil 72. At this same time inductance of the electrical circuit is high due to the physical presence of armature 47 within coil 72. High inductance with a constant AC voltage means a decrease in Ac current flow. High inductance occurs when the valve is open.

The well operator is interested in one light to show that valve 35 open and one light for closed. Many physical characteristics could be sensed to turn the lights on and off. For example, voltage applied or current flow through coil 72. However, just the presence of voltage or current does not indicate the true position of armature 47 and a sensing of the change in current is required.

Magnetic fields do not like change and generate voltage to resist change. The previously noted change in reluctance generates back EMF as armature 47 moves to the valve open position. Current cannot change instantaneously therefore measurement of back EMF is some indication of armature movement. A preset timer can also be used to turn the lights on and off, however, time just like voltage and current is not a true indication of valve position.

The formula for inductance (L) demonstrates that the value of inductance is a function of the physical characteristics of coil 72. Movement of armature 47 changes at least one physical characteristic-permeability. Effective cross section area might be changed however, permeability is certainly the dominant factor. AC voltage and AC current flow are sensitive to changes in inductance. The required AC current flow could be relatively insignificant as compared to the DC opening current or the smaller DC hold open current. 60 Hertz and 400 Hertz AC voltage generators are commonly available. It will be appreciated that specific values of inductance are a function of the operating environment - well fluids, casing, tubing, earth formation, etc., and materials used to manufacture valve 35. Safety valves form identical materials will have variations in inductance due to variations in manufacturing tolerances (e.g. length and air gap). For a specific valve in a specific environment coil 72 will have a unique value of inductance for armature 47 in the valve open and valve closed positions. Equipment to measure inductance is commercially available from many companies, including Hewlett-Packard.

The position of armature 47 can also be sensed by limit switches which are tripped at the end of each stroke. Limit switches could compromise the fluid integrity of housing 41 and Reed switches are an alternative type of limit switch. A small solenoid(s) could also be placed in housing 41 to sense movement of armature 47. Measuring the inductance of coil 72 is as accurate indication of armature position as any of these alternatives and does not add any extra cost or complexity to valve 35.

The circuit of FIG. 2 also has the added capability of constantly monitoring the open/closed condition of the safety valve as a function of the solenoid armature position and varying the valve operations based upon its condition. Valve condition monitoring is accomplished by comparing the measured inductance of the coil of the solenoid with known open valve and closed valve inductance values. The inductance of the solenoid actuating the valve changes as a function of the position of the armature within the coil of the solenoid. Regular periodic or constant monitoring of the valve position allows highly useful operational features to be incorporated into the present system such as "valve open" and "valve closed" indications, valve position indications, and high and low power control features based upon valve position.

As shown in FIG. 2, the solenoid coil 172 used to actuate the safety valve is connected to the rest of the circuit 125 which is located at the surface by means of electrically conductive well tubing and casing, schematically represented at 122. The conductive path passes through a relatively low holding current power supply, illustrated by battery 123, a protection diode 124, a control switch 121, and a current monitoring resistor 126. A relatively higher value actuation current source, represented by battery 127, is connected in parallel through a normally open contact 128 of a contactor relay 129. The relay 129 includes an actuation coil 132 which closes the contacts 128 and connects the higher power source 127 to the conductive path 122 leading to the solenoid coil 172. Current flow through the monitoring resistor 126 is coupled to an inductance monitor circuit 133 the output of which is connected to a solenoid position logic circuit 134. The output of the logic circuit 134 is in turn connected to a decision logic circuit 135 which is powered by a voltage source 136 coupled to the circuit by means of a switch 137. The decision logic circuit 135 is also connected to a momentary contact switch 138. The solenoid position logic circuit 134 includes a valve open indication lamp 141, a valve closed indication lamp 142 and a current flow meter 143.

More switch 121 is closed, the lower power source 123 supplies a low voltage current through the diode 124 and the current measuring resistor 126 to the solenoid coil 172. Whenever switch 137 is closed power is supplied from source 136 to the monitor/logic circuits and measurement of the inductance of the solenoid coil 72 by means of inductance monitor circuit 133 begins. Depression of momentary contact switch 138 causes the decision logic circuit 135 to supply current to the coil 132 of relay 129 closing the contacts 128. This applies a relatively high voltage current from source 127 through resistor 126 to the solenoid coil 172 causing it to actuate and open the safety valve. When the armature of the solenoid coil 172 changes position to open the valve, the change in current flow through resistor 126 is detected by the inductance monitor circuit 133 which provides a signal to the solenoid position logic circuit 134. The open valve indication lamp 141 is then illuminated and the closed valve indication lamp 142 is extinguished. When the solenoid position logic circuit 134 detects that the valve has reached its open or predetermined position, it provides a signal to the decision logic circuit 135 which removes current from the coil 132 of the relay 139 to interrupt the flow of the relatively high current value from the source 127 to the solenoid coil 172. The decision logic circuit 135 limits the time period during which a high power value is applied to the solenoid coil 72 in case the valve does not open during this preselected time period. In addition, the decision logic circuit 135 also allows the reapplication of current to the relay 129 after a preselected time period in order to try and reopen the valve after a selected cool-down period in the event the solenoid fails to fully open or partially closes after the first attempt to open.

In FIG. 2, the diodes 124 and 131 protect the switches 121 and 128 from high values of back EMF during the valve opening process. The resistor 126 provides a voltage drop used in the monitoring of the inductance of the solenoid coil 172. The inductance monitor circuit 133 may also send a high frequency signal, for example around 60–120 $H_z$ down the conductive path 122 to the coil 172 in order to monitor changes in the returned signal for purposes of determining the inductance value of the coil and thereby indicating the open/closed state of the valve. In the circuitry of FIG. 2, the operating/monitor circuit shown therein is capable of detecting a valve closure or partial closure with both low and/or high power applied to the solenoid coil 172 and not just during the normal open/closed cycle as a function of back EMF generated by the solenoid coil as in prior art circuits.

Figure 3A:
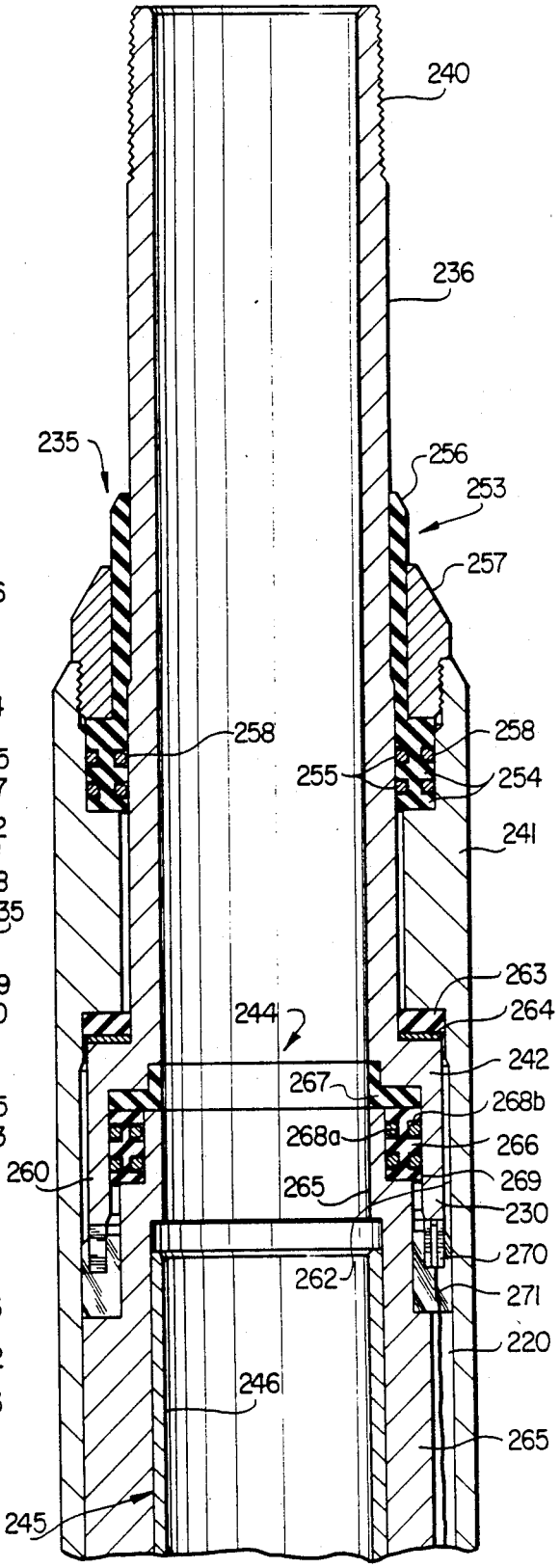
FIG. 3A-3D are longitudinally cross-section drawings of the embodiment of the solenoid operated safety valve assembly shown in FIG. 1.

Referring next to FIGS. 3A–3D, there is shown a longitudinal cross-sectional view through the tubing and solenoid/safety valve assembly showing the structure of one embodiment of a solenoid actuated safety valve which is related to the preferred embodiment of the invention set forth below in connection with FIGS. 4, 5 and 6A–6D. Referring first to FIG. 3A, the upper end 240 of the assembly support flange 236 is threaded at 240 for coupling to the lower end of a conventional tubing section extending from the surface. The housing 241 of the solenoid actuated safety valve assembly 235 may be illustratively formed of a conventional relatively less magnetic steel such as 9CR-1MOLY. The assembly support flange 236 is mechanically secured into the upper end of the housing 241 by means of a threaded cylindrical housing seal cap 257. Received between the housing seal cap 257 anD the support flange 236 is a cylindrical upper insulating o-ring adaptor 253 comprising an upper cylindrical portion 256 and a lower radially outwardly flaring portion 258 of greater diameter and thickness. A pair of external groves 254 and a pair of internal groves 255 receive respective pairs of sealing o-rings on the inside surface abutting the outer wall of the support flange 236 and pairs of sealing o-rings on the outside surface abutting the inside wall of the housing. The lower end of the conductive support flange 236 includes a radially outwardly extending flange portion 242 which flares to a radially increased diameter portion 230 received into a recess 262 within the wall of the housing 241. An upper insulating washer 263 and a spacer 264 separate the upper inside shoulder of the housing 241 from the lower shoulder of the radially flared region 242 of the assembly support flange 236. The upper end of a coil housing insert 265 includes an inwardly stepped region which reservoir a lower insulating o-ring adaptor 266 which includes a pair of internal groves **268*a* and a pair of external groves 267*b* for receiving, respectively, pairs of o-rings which seal against the inner surface of the wall of the support flange 236 and the outer surface of the housing insert 265. A lower insulating washer 267 serves to space and electrically insulate the upper end of the housing insert 265 from the lower end of the support flange 236. The housing insert 265 and is in direct mechanical and electrical contact with the conductive inner walls of the cylindrical housing 241**.

The lower edge of the conductive support flange 236 includes an electrical connector 270 which is coupled to a single conductor 271 which extends down a vertical groove 220 formed between the inner wall of the housing 241 and the outer wall of the housing insert 265. The conductor 271 extends downwardly and is connected to one end of the solenoid coil 272 mounted in the annular space between the inner well of the housing 241 and the outer wall of the housing insert 265. The other end of the solenoid coil 272 is connected via a single conductor wire 275 into a hole 276 in the lower end of the edge portion of the solenoid coil housing insert 265 and retained with a set screw (not shown). The housing insert 265 is mechanically and electrically connected to the housing 241.

A multi-element cylindrical operator tube 245 includes a relatively thin walled upper segment 246 formed of a relatively less magnetic material such as a 9CR-1MOLY steel which also is highly resistant to the highly corrosive borehole fluid environment. The upper segment 246 is threadedly connected to an armature segment 276 which is formed of highly magnetic material such as 1018 low carbon steel alloy which is also highly corrosion resistant. A thin walled, elongate lower segment 248 of the operator tube 245 is threaded to the lower end of the armature segment 276 and formed of the relatively less magnetic material such as 9CR-1MOLY steel. The segment 250 of the operator tube 245 located at the lower end is also of relatively low magnetic material and includes a radially extending edge which abuts a radically extending circular washer 249. The washer overlies and rests on the upper end of a helical spring 251 the lower end of which rests on one of a plurality of stacked cylindrical spacers 281, 282 and 283 which are positioned in a recess in the side wall of the housing 241 against a lower edge thereof 284. The operator tube 245 is adapted for longitudinal movement within the axial passageway 244 formed down the center of the housing 241.

The operator tube 245 is positioned in the passageway 244 of the housing 245 so that the armature segment 276 extends above the upper end of the solenoid coil 272. A tubular magnetic stop member 260 is positioned inside of the housing insert 265 extending below the lower end of the solenoid coil 272. A mechanical stop 290 located at the bottom of the cavity 253 formed in the wall of the housing 241 below the end of the operator tube segment 250 limits the extent to which the tube 245 can move in the downward direction. When the operator tube is at its lowest position and abuts the mechanical stop 290 the lower edges **276*a* of the armature segment 276 are spaced by a small but definite air gap from the upper edges 260*a* of the magnetic stop 260. The magnetic stop 260 is formed of a highly magnetic material to form a low reluctance path for magnetic flux generated by the solenoid col 272 when the armature is in the lower position. This allows the armature 276 to be held adjacent to the magnetic stop 260 by a value of current flow through the solenoid 272 much less than that required to move the operator tube in the downward direction from its upper rest position. The air gap between the lower end edge 276*a* of the armature 276 and the edge 260*a* of the magnetic stop prevent the pieces from sticking together due to residual magnetism when all current has been removed from the coil 272**.

Figure 3D:
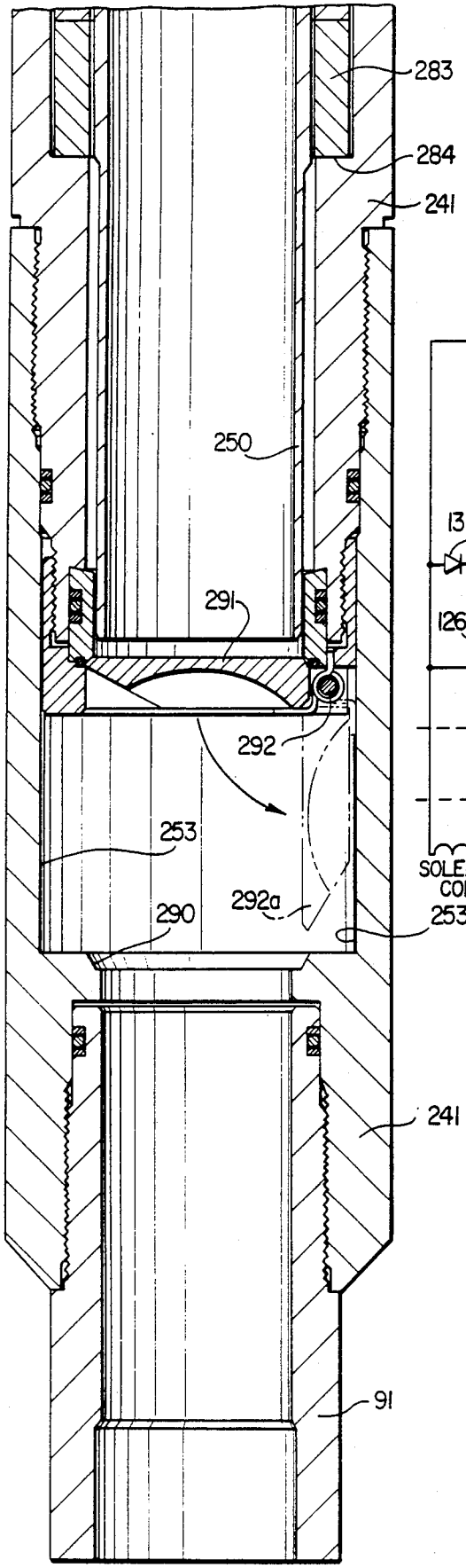

Referring now to FIG. 3D, near the lower end of housing 241 a safety valve flapper 291 is pivotally connected by means of a hinge 292 to the lower end of the housing 241 and pivots about the hinge 292 to the position shown in phantom at **292*a* to open the flow through the valve in response to actuation of the solenoid. The hinge 292 also includes a spring which normally biases the flapper 291 into the closed position as shown. Movement of the tubular member 245 in a downward direction toward mechanical stop 290 causes the flapper 291 to pivot about the hinge 292 into the phantom position 292*a* and allow fluid flow upwardly into the lower end of the housing 241 and the axial passageway 244** and upwardly through the valve assembly and the tubing toward the surface.

As can be seen from FIG. 3D, when the tubular member 245 moves downwardly in response to magnetic forces produced by current flowing through the windings of the solenoid 272, it presses against the flapper door 291 causing the flapper to move about the hinge 292 into the open position shown in phantom at **292*a* and allow the flow to production fluids up the tubing leading to the surface. Upon interruption of the current flow through the solenoid coil 272, the helical spring 251 biases the tubular member 245 upwardly allowing the spring biased hinge 292 to move the flapper door 291** toward the closed position.

Current flow through the solenoid 272 comes through the tubing into the support flange 236, the connector 270 and the conductor 271 into one end of the solenoid coil 272. The other end of the coil 272 is connected to conductor 275 and then through connector 276 to the conductive housing insert 265 and to the side walls of the housing 241 which are, of course, insulated from the support flange 236 by means of the insulative upper o-ring adaptor 253 and other insulating elements discussed above.

The electrically conductive housing 241 is connected to the side walls of the wall casing by means of slips, as shown in FIG. 1, to complete the electrically conductive path back to the surface via the casing 11. This allows current flow to both initially change the state of the solenoid controlling the valve as well as hold the valve in an open position by means of a lower value of current flow than that necessary to change its state.

Figure 4:
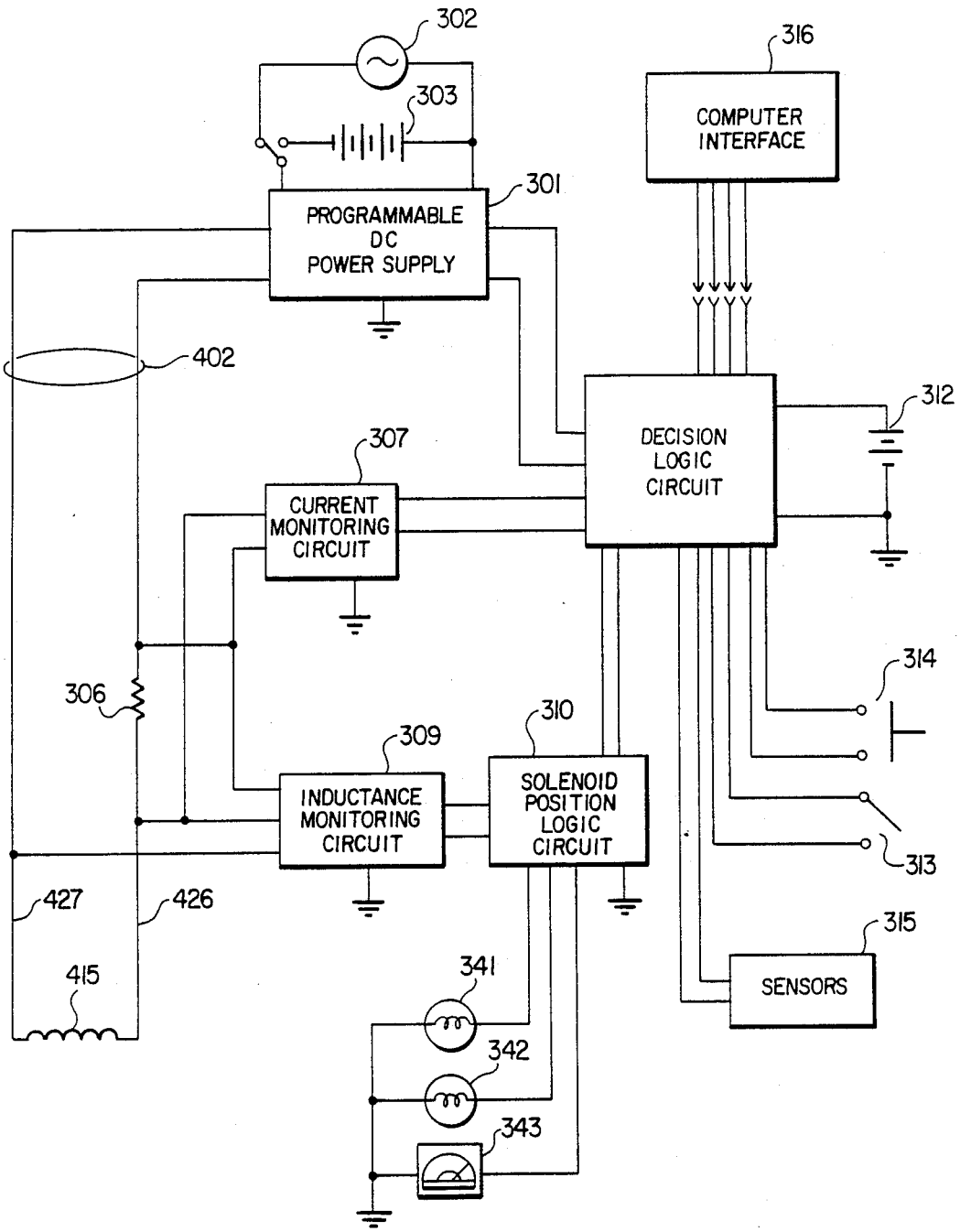
FIG. 4 is an electrical schematic diagram of the preferred embodiment of the electrically operated solenoid actuated safety valve system of the present invention.

Referring now to FIG. 4, there is shown a constant current solenoid power supply circuit which may be employed in certain embodiments of the system of the present invention. The preferred control system will produce a constant current output. Current flow in the solenoid 415 is the determining factor for valve operation both in initially opening the valve and holding it open. With a constant current value being supplied from the monitoring and control circuit located at the surface, changes in the depth within the borehole at which the solenoid actuated safety valve is positioned do not require any change or modification to the control system. Of course, a given control system will have a maximum setting depth, i.e., the maximum power output (a variable control voltage x constant current) for a given control system will determine the maximum setting depth for the solenoid actuated control valve being supplied.

FIG. 4 shows a schematic drawing of the preferred embodiment of the circuit for operating and monitoring the condition of a solenoid actuated safety valve in accordance with the system of the present invention. Like FIG. 2, the circuit of FIG. 4 has the capability of actuating the solenoid operated valve from a closed to an open position by the application of a relatively high value of DC current to change the state of the solenoid and then holding the valve in the open position by applying a relatively lower value of current to the solenoid. The circuit of FIG. 4 also includes the capability of supplying a constant value of current, both as to the higher initial current value to operate the solenoid and the lower holding current value, regardless of the depth within a wall at which the solenoid valve is located. Thus, a single power supply unit may be used for different well installations without modification and thereby ensure that the optimum value of current will be supplied to the solenoid regardless of the depth.

A programmable DC power supply 301 is supplied from a power source which may consist of either an AC power source 302 or a DC power source such an operating battery 303. If the source is AC, then the power supply 301 may consist of a programmable DC power supply. If the power source is a battery 303, then the power supply 301 will consist of a programmable DC to DC converter. The output of the DC power supply 301 is connected to a cable 402 leading downhole and includes a pair of conductors 426 and 427 coupled to supply current to the solenoid coil 415 within the valve. A current monitoring resistor 306 is connected in one leg 426 of the supply circuit to monitor the current flow to the solenoid coil 415. The value of the resistor 306 is preferably on the order of 0.1 ohm to 0.5 ohms. A current monitoring circuit 307 has its input connected across the current monitoring resistor 306 and its output connected to a decision logic circuit 308. An inductance monitoring circuit 309 is connected across the conductors 326 and 327 and, thus, across the solenoid coil 45 to monitor the inductance thereof in response to the movement of the armature within the coil. The inductance monitoring circuit 309 is also connected across the current monitoring resistor 306. The output of the inductance monitoring circuit is connected through a solenoid position logic circuit 310 the output of which is connected to the decision logic circuit 308. The solenoid position logic circuit 310 controls the actuation of a plurality of solenoid position indicators on a control panel comprising a valve open indicator lamp 341, a valve closed indication lamp 342 and a current flow meter 343. Power to operate the decision logic circuit 308 is supplied by a controller battery 312 while control signals are furnished through an actuation toggle switch 313 and an actuation momentary contact switch 314. A plurality of sensors 315 may comprise conventional devices used to sense temperature, pressure, flow, or a combination of all three to provide an input to the decision logic circuit 308 for use in controlling the actuation of the solenoid of the safety valve. A computer interface, including a keyboard and a display, 316 is connected to the input of the decision logic circuit to allow changing to the values by the decision logic circuit in its operation. The computer interface 316 also has the capability of monitoring valve operation and position for recording such and/or transmission of that information to other locations. Additionally, the computer interface 316 can be used to control the operation of valves from a remote location or as part of an overall electronic control system for a well or field of wells. The computer interface 316 includes a removable keyboard and display which allows the device to be transported to different wells for periodic use.

In operation, closing of the toggle switch 313 provides a signal to the decision logic circuit 308 which controls the programmable power supply 301 to begin increasing the voltage to the cable 402 leading downhole to the solenoid 415 of the valve. As the voltage on the line 402 is increased, the current across the current monitoring resistor 306 also increases indicating the amount of current which is being supplied to the solenoid coil 415. When the current monitoring circuit 309 indicates to the decision logic circuit 308 that the current through the resistor 306 has reached the preselected value, the decision logic circuit 308 signals the programmable power supply 301 to stop increasing the voltage. At this point, the preselected high value of current is being pulled to the solenoid coil 415 for actuating the solenoid.

The inductance monitoring circuit 309 and solenoid position logic circuit 310 monitor the position of the armature within the solenoid coil 415 and control the solenoid position indicators 341/342 to display that position and at the same time pass that information on to the decision logic circuit 308. If the solenoid valve opens or if the high power has been applied to the solenoid coil 415 for a preselected period of time, the decision logic circuit 308 signals the programmable power supply 301 to begin reducing the output voltage. The value of current through the resistor 306 is monitored by the circuit 307 and when a lower preselected value is reached, the decision logic circuit 308 signalS the programmable power supply 301 to stop decreasing the voltage and hold that value. The solenoid coil 415 is now being supplied with the preselected low value of hold open current for the valve.

The momentary contact switch 314 allows a high value current to be applied to the solenoid coil 415 while the low power is still on. This feature is used in the event the valve initially failed to open or only partially open. Depressing the momentary contact switch 314 signals the decision logic circuit 308 to repeat the high power cycle while using internal timers to prevent high power from being applied more frequently than at preselected intervals to sustain a preselected minimum cool down period for the coil between current surges.

The solenoid coil 415 is deenergized by a signal from either the toggle switch 313 or any one of the sensors 315 to decision logic circuit 308 indicating that the power should be interrupted to the solenoid coil 415.

As can be seen, the circuit of FIG. 4 includes the provision of a current monitoring system which enables the application of a constant preselected values of current to the coil regardless of various operating conditions.

Figure 5:
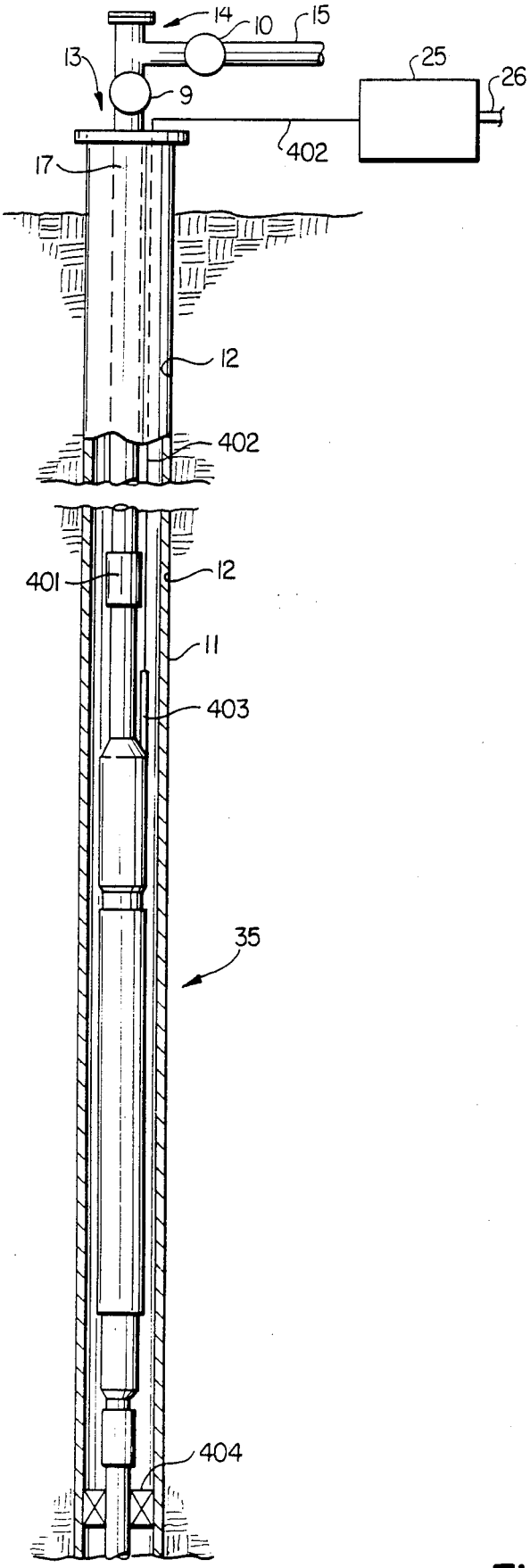
FIG. 5 is a schematic drawing of a well completion including an illustrative cross-sectional view of a electrically operated solenoid actuated safety valve system constructed in accordance with the preferred embodiment of the system of the present invention.

Referring next to FIG. 5, there is shown a schematic cross-sectional illustration of the preferred embodiment of a well completion incorporating the electrically operated solenoid actuated safety valve system of the present invention. A casing 11 is positioned along the borehole 12 formed in the earth and extending from a wellhead 13 located at the surface down into the petroleum producing geological formation. The wellhead 13 includes a Christmas tree type production flow control configuration 14 having an output line leading to storage facilities (not shown) for receiving production flow from the well. A tubular production conduit 17 extends from the output line 15 through flow control valves 9 and 10 and coaxially down the casing 11 to the depth within the borehole at which the producing region of the formation is located. At the lower end of the tubing 17 there is positioned a solenoid safety valve assembly 35 that is coupled to the lower end of the tubing by means of a coupling 401.

A wellhead monitoring and control circuit 25 is connected to a source of AC electric current by means of a cable 26 and includes means for rectifying current from that source and producing a DC voltage on two conductors of a power cable 402. The power cable 402 extends down the casing 11 adjacent the tubing 17 and is connected to the safety valve 35 by means of an electrical coupling extension 403. The region of the casing 11 below the safety valve 35 is closed by means of a packer 404 located between the tubing and casing below the lower end of the safety valve 35.

Figure 6A:
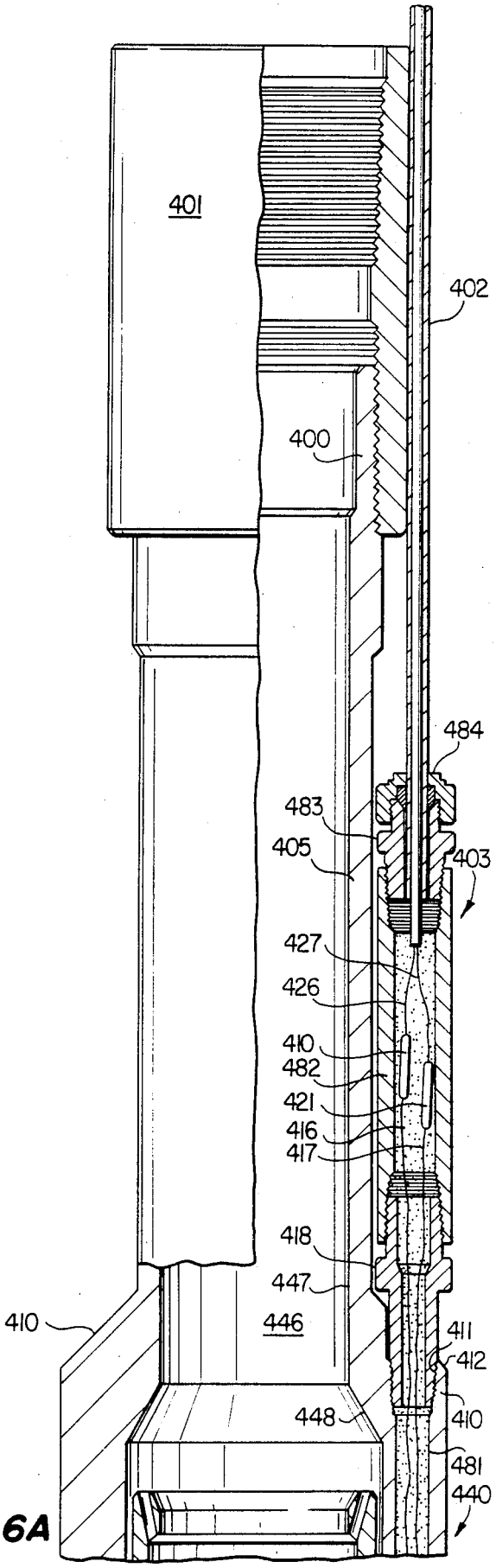
FIG. 6A–6D are longitudinal cross-section drawings of the solenoid actuated safety valve assembly of the preferred embodiment of the system of the present invention shown in FIG. 5.
Figure 6B:
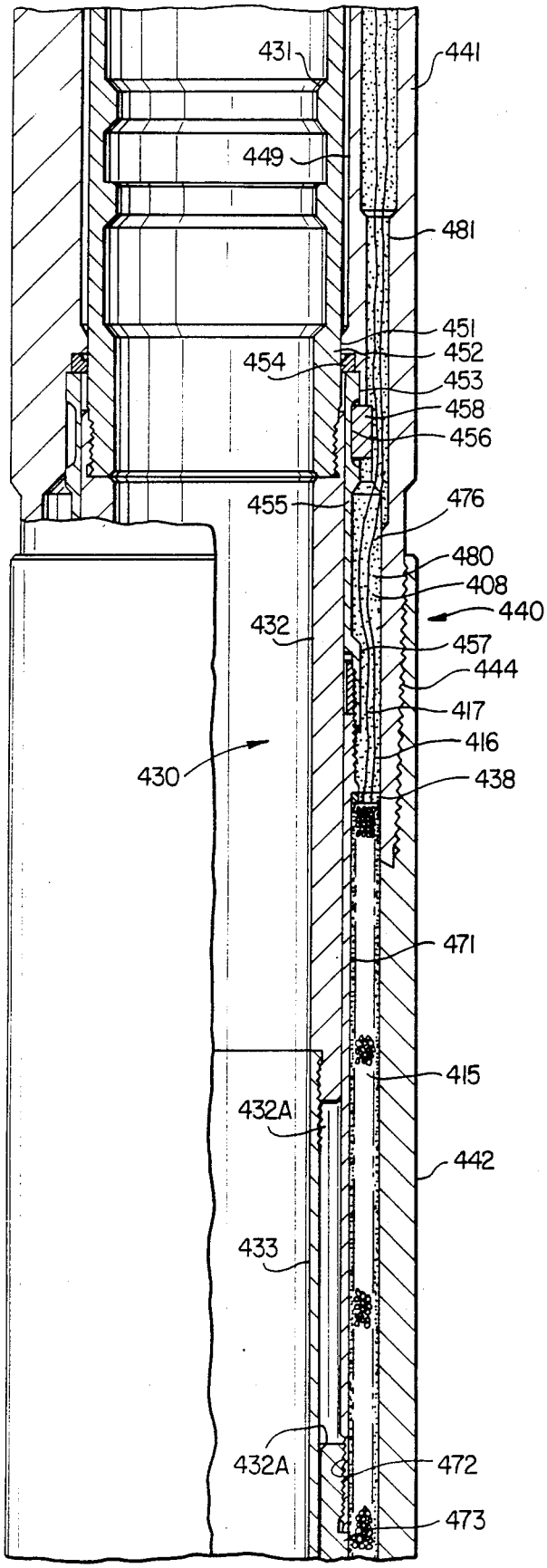
Figure 6C:
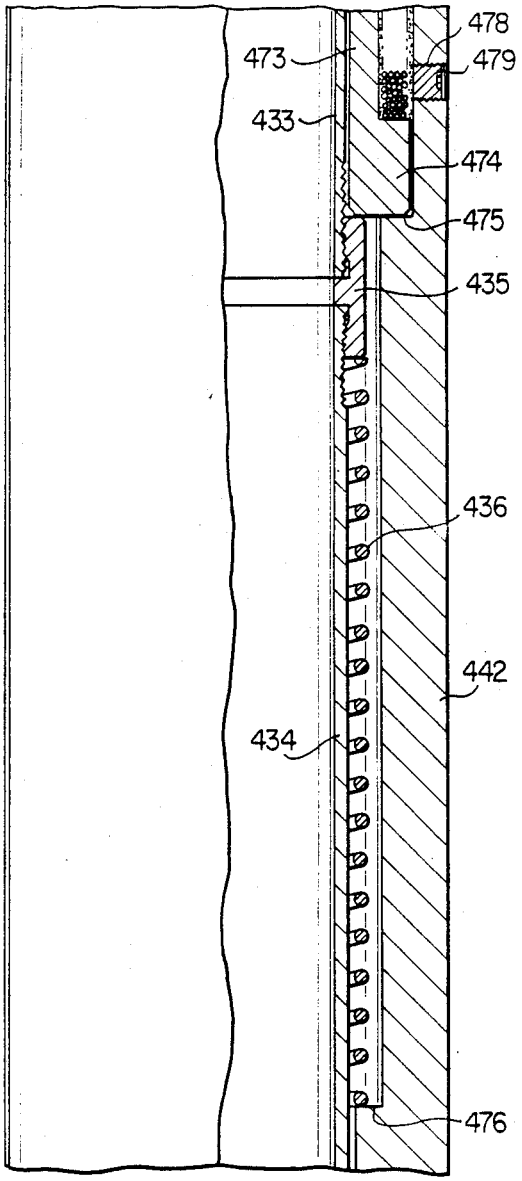

Referring next to FIGS. 6A–6D, there is shown a partially cut-away longitudinal cross-sectional view through the tubing and solenoid actuated safety valve assembly showing one configuration in which the preferred embodiment of the safety valve of the present invention can be implemented. The body of the valve assembly 440 includes an upper housing 441, a lower housing 442 and a bottom sub 443. Referring first to FIG. 6A, the upper end of the assembly 440 is threaded to 400 for coupling to the lower end of a conventional tubing section 17 extending from the surface by means of a threaded junction 401. The upper housing 441 is threadedly coupled to the lower housing section 442. The walls of the upper and lower housing sections 441 and 442 and the bottom sub 443 are relatively thick and form the load bearing members of the valve assembly 440 and may be illustratively formed of a conventional relatively less magnetic steel such as 9CR-1MOLY. The upper housing 441 of the valve assembly 440 is connected to the threaded portion 400 by means of a reduced neck section 405. The lower end of the neck section 405 includes an outwardly flaring shoulder region 410 into which extends an axial bore 481 the open end of which extends through the conical face 412 of the shoulder region 410 and includes threads 411. The upper housing section 441 of the valve assembly 440 is threadedly coupled to the lower section 442 by means of mating threads 444. Similarly, the lower end of the lower housing section 442 is threadedly coupled to the bottom sub section 443 by means of a threaded coupling 445.

The interior of the valve assembly 440 includes an axially extending fluid conduit 446 the upper end of which is defined by a cylindrical inner wall 447 within the neck section 405 and which flares radially outwardly at conical transition region 448 and extends downwardly as a cylindrical wall 449 having an inwardly extending ridge 451 located near the lower edge thereof. The lower edge of the inner wall 449 beneath the ridge 451 includes a first radially outwardly extending stepped region 452 and a second radially outwardly extending stepped region 453. The first stepped region 452 receives a low friction rectangular scraper ring 454 for excluding sand and trash from between the housing internal diameters and the moving tubular valve armature. The second stepped region 453 receives the upper end of an anti-rotation adjustment tube 455 which allows for threaded adjustment of the length of the solenoid coil assembly and tubes so that there is a snug fit when the upper and lower housings 441 and 442 are screwed together regardless of tolerance build up in the parts. The outer surface of the anti-rotation adjustment tube 455 is generally cylindrical with a circular upper recess 456 and a radially outwardly flared lower foot portion 457 having adjustment threads formed on the inner surface thereof. Received within a radially inwardly extending upper recess 456 formed in the outer wall of the adjustment tube 455 is a steel pin 458 used to prevent rotation of the solenoid coil relative to the upper housing 441 and eliminate twisting and cutting of the solenoid coil wires.

The interior of the lower housing section 442 receives a cylindrical coil tube 471 having external threads on the upper end thereof which engage the internal threads on the foot portion 457 of the anti-rotation adjustment tube 455. The coil tube 471 is a thin walled, non-load-bearing tube formed of a nonmagnetic stainless steel around which the solenoid coil 415 is wound. The coil tube 471 extends downwardly and includes an internally threaded section 472 which engagEs the externally threaded upper edge of a relatively thick cylindrical magnetic stop 473. The lower end of the magnetic stop 473 includes a radially outwardly extending flange region 474 which engages the radially outwardly extending stepped region 475 formed in the inner wall of the lower housing 442. The cylindrical magnetic stop 473 provides a magnetic stop for the armature 432 of the operator tube 430. When the lower edge of the armature 432 is positioned close to the stop 473 the magnetic attraction between them is very high for a given value of solenoid current. Both the magnetic stop 473 and the armature 432 are made from a soft magnetic material having a low value of residual magnetism. The stepped region 475 extends radially inwardly approximately one-half the thickness of that section of the wall of the lower housing section 442. A second radially extending stepped region 476 is positioned near the lower end of the lower housing section 442 and receives the lower end of a helical spring 436 used to bias the operator tube 430 in the upward direction.

Figure 6D:
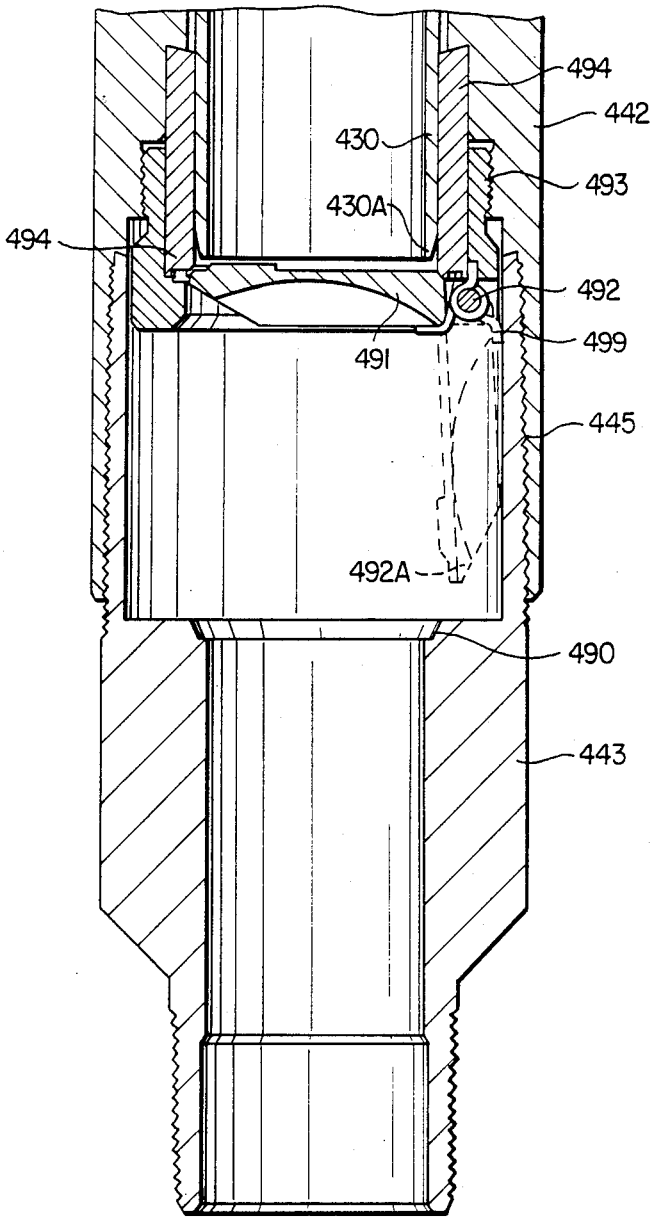

As can be seen from FIG. 6D, the lower end of the lower housing section 442 mounts a safety valve flapper 491 which is pivotally connected by means of a hinge 492 to flapper housing assembly 493 which is received into the lower end of the lower housing assembly 442. The safety valve flapper 491 pivots about the hinge 492 to the position shown in phantom at 492A to open the flow through the valve in response to actuation of the solenoid. The hinge 492 also includes a spring 499 which normally biases the flapper 491 into the closed position against the valve seat insert 494 as shown. Movement of the operating tube 430 of the solenoid, which will be further described below, in a downward direction, toward the mechanical stop 490 causes the flapper 491 to pivot about the hinge 492 into the phantom position 492A and allow fluid to flow upwardly into the lower end of the housing 440, through the axial passageway 446 and upwardly through the valve assembly and the tubing 17 toward the surface.

Referring again to FIG. 6A and 6B, the upper housing section 441 includes a cylindrical annular region 476 formed between the inner well surface of the upper housing section 441 and the outer surface of the anti-rotation adjustment tube 445 and the coil tube 471. This annular region 476 extends down adjacent the inner wall of the upper housing section 441, adjacent the inner wall of the lower housing region 442 and terminates at the upper edge of the stepped region 477 formed by the radially outwardly extending flange 474 of the magnetic stop 473. A radially extending threaded aperture 478 is formed through the walls of the lower housing section 442 and is closed by means of a threaded insert 479.

A cylindrical solenoid coil 415 is wound from high temperature magnetic wire around the thin cylindrical coil tube 471 and is positioned in the annular cavity 476 formed between the inner wall of the lower housing section 442 and the outer wall of the coil tube 471 and magnetic stop 473. The ends of the wires forming the solenoid coil 415 extend as single conductors 416 and 417 upwardly through the annular space 476 and through an elongate cylindrical bore 481 which is formed within the wall of the upper housing section 441 and is connected to the threaded opening 411. The upper end of the electrical coupling extension 403 comprises a plug member 418 having threads on the lower end, which engage the threaded opening 411 in the bore 481, and threads on the upper end which engage a cylindrical extension member 482. An upper fitting 483 comprises a thermocouple connector which threadedly engages the upper end of the extension 482 and receives, through a threaded cap member 484, the monitoring and control cable 402 extending from the surface to the downhole safety valve. A pair of conductors 426 and 427 contained within the cable 402 are connected to the conductors 416 and 417 extending from opposite ends of the solenoid coil 415 by means of splice members 420.

A multi-element cylindrical operator tube 430 includes a relatively thin wall upper segment 431 formed of a relatively less magnetic material such as 9CR-1MOLY steel which is resistant to the highly corrosive borehole fluid environment. The upper segment 431 is threadedly connected to a cylindrical armature segment 432 which is formed of highly magnetic material such as 1018 low carbon steel alloy which is also highly corrosion resistent. A thin wall, elongate lower segment 433 is threaded to the lower end of the armature segment 432 and is formed of relatively less magnetic material such as 9CR-1MOLY steel. A similar thin wall, elongate lowest segment 434 of the operator tube 430 is threaded to the lower end of the lower section 433 by means of a junction flange 435. The lowest segment 434 is also formed of a relatively less magnetic material such as 9CR-1MOLY steel. The lower edge of the junction flange 435 abuts the upper end of a helical coil spring 436 the lower end of which abuts the upper surface of the stepped region 470 in the lower housing section 442. The spring 436 serves to spring bias the entire operator tube 430 into the upward direction holding the upper edge of the junction flange 435 against the lower edge of the radially outwardly extending flange 474 of the magnetic stop 473 in the absence of current through the solenoid coil 415. The operator tube 430 is adapted for longitudinal movement within the axial passageway 446 formed down the center of the housing 440.

The operator tube 430 is positioned in the passageway 446 of the housing 440 so that the armature segment 432 extends above the upper end of the solenoid coil 415. The tubular magnetic stop member 473 is located near the lower end of the solenoid coil 415. A mechanical stop 490 is located at the bottom of the passageway 446 in the bottom sub section 443, and below the lower end of the operator tube 430 in its lower most position, to limit the extent to which the tube 430 can move in the downward direction. When the operator tube 430 is at its lowest position, the lower edges of the operator tube 430A abut the mechanical stop 490 while the lower edges of the armature segment 432A spaced by a small but definite air gap from the upper edges 473A of the magnetic stop member 473. The magnetic stop 473 is made of a highly magnetic material to form a low reluctance path for magnetic flux generated by the solenoid coil 415 when the armature 432 is in the lower position. This allows the armature 432 to be held adjacent to the magnetic stop 473 by a value of current flow through the solenoid 415 much less than that required to initially move the operator tube 430 in the downward direction from its upper rest position. The air gap between the lower edge 432A of the armature 432 and the upper edge of 473A of the magnetic stop 473 prevent the pieces from sticking together due to residual magnetism when all current has been removed from the coil 415.

Referring now to FIG. 6D, near the lower end of the housing 440 the safety valve flapper 491 is pivotally connected by means of the hinge 492 to the lowest end of the lower housing section 442 and pivots about the hinge 492 to the position shown in phantom at 492A to open the flow through the valve in response to actuation of the solenoid. The hinge 492 also includes a spring 498 which normally biases the flapper 491 into the closed position as shown. Movement of the operator tube 430 in a downward direction toward the mechanical stop 490 causes the flapper 491 to pivot about the hinge 492 into the phantom position 492A and allow fluid flow into the lower end of the housing 442, through the axial passageway 446 and upwardly through the valve assembly and the tubing toward the surface.

As can be seen from FIG. 6D, when the operator tube 430 moves downwardly against the force of helical spring 436 in response to magnetic forces produced by current flowing through the windings of the solenoid 415, the lower edges 430A press against the flapper door 491 causing the flapper to move about the hinge 492 into the open position shown in phantom at 492A and allow the flow of production fluids up the tubing leading to the surface. Upon interruption of the current flow through the solenoid 415, the helical spring 436 again biases the operator tube 430 upwardly allowing the spring biased hinge 492 to move the flapper door 491 toward the closed position.

Current flow to energize the solenoid 415 comes through the conductors 426 and 427 contained within the monitor and control circuit cable 402 and the splices 420 and 421 into conductors 416 and 417 forming the opposite ends of the windings of the solenoid coil 415. From the splices 420 and 421 the conductors 416 and 417 extend downwardly through the cylindrical bore 481 in the side wall of the upper housing portion 441 and through the angular region 480 to the upper edge of the solenoid coil 415.

The preferred embodiment of the solenoid actuated safety valve of the invention shown in FIGS. 6A–6D, is assembled as follows.

The solenoid coil 415 is first wound upon the coil assembly comprising the coil tube 471 and magnetic stop 473. The threaded anti-rotation adjustment tube 455 is added to the upper end of the coil tube 471. When the upper segment 431, armature 432, lower section 433 and lowest section 434 are joined to form the elongate operator tube 430 it is inserted down into the upper end of the coil tube 471 so that the armature 432 is positioned above the upper edge 473A of the magnetic stop 473. Next, the helical coil spring 436 is placed over the lower end of the operator tube 430 so that its upper end abuts the lower surface of the junction flange 435. This subassembly is then placed down into the open end of the lower housing section 442 so that the lower end of the spring 436 abuts the stepped region 476 and the lower edge of the magnetic stop abuts the stepped region 475. This positions the solenoid coil in the annular region 480 between the coil tube 471 and the inner wall of the lower housing section 442.

The scraper ring 452 is placed over the upper end of the operator tube 430 before assembly of the housing sections 441 and 442. The upper housing 414 is then threadedly engaged with the lower housing section 442 and the anti-rotation adjustment tube 455 is adjusted in length so that the coil assembly fits snugly within the annular space 480. The conductors 416 and 417 comprising the ends of the wire coil forming the solenoid coil 415 are threaded up through the annular region 480, through the cylindrical bore 481 and out the threaded opening 411 formed in the conical face 412 of the upper section 441. The threaded plug member 418 is screwed into the threaded opening 411 and the conductors 416 and 417 are passed through it to extend out its upper end.

Once these parts are in place, the threaded plug 479 is removed from the aperture 478 in the wall of the lower housing section 442. An electrically insulative filler 408, such as an epoxy material, is injected through the threaded opening 411 down through the bore 481 to fill the entire annular region 480 and all the space between the outer walls of the tubular solenoid coil 415, the coil tube 471, the anti-rotation adjustment tube 455 and the inner walls of the outer housing sections 441 and 442. The filler 408 is represented in the drawing by stippling and is injected in a manner so as to fill every space and crevice within these regions with the excess exiting through the opening 478 located near the lower end of the solenoid coil 415. The entire inner region surrounding the solenoid coil 415 is filled along with the bore 481 containing the conductors 416 and 417 leading to the cable 402. In this way, the solenoid coil and the wires are protected from corrosive borehole fluids without the use of mechanically sealing parts and additional sealing members. Once all of the excess filler 408 has passed from the opening 478, the plug 479 is inserted into the opening 478 and sealed to the wall of the lower housing portion 442.

There are two primary functions which are performed by the filler material 408. The first is to isolate the downhole well pressures and the borehole fluids from the electrical conductors 416 and 417 extending from the solenoid coil 415 through the threaded plug 418. The filler 408 must allow passage of the conductors while remaining pressure tight. Materials suitable for such pressure tight use include a high tear strength silicone elastomer sold under the trade designation Sylgard 186 by Dow Corning. The second function performed by the filler 408 is to act as a filler and additional insulation for the coil wires and protect the solenoid coil 415 from harmful well fluids but not necessarily to hold pressure. This function is performed primarily within the annular region 476 forming the coil chamber and around the solenoid coil 415. Materials suitable for use as a coil chamber filler include flexible epoxy, RTV Compounds and insulating greases. For example, one such material is the grease-like, non-melting, water repellant, high-dielectric strength silicone fluid sold under the trade designation 111 Silicone Compound by Dow Corning. As can be seen, the filler material 408 can be of one type in and around the solenoid coil 415 and of a different type from that point upwardly to the top of the threaded plug 418 or, instead, it can be of a uniform type through the filled regions within the safety valve cavities.

Epoxy resins which can be used in the encapsulation procedure described above, are preferably low viscosity, two-part compounds designed for potting, sealing and mounting electric components. Such a material which has been found suitable for this use is sold under the tradename of Megabond TM general purpose epoxy manufactured by the electronic division of Loctite Corporation, of Newington, CT.

Once the internal parts of the body of the housing have been filled as described above, the extension tube 403 is threaded onto the threaded plug 418 and the wires 416 and 417 are spliced into contact with the wires 426 and 427 leading from the monitoring and control circuit cable 402. When these connections aRE made, the cylindrical space within the extension 403 may also be filled by a filler material 408 prior to insertion of the upper plug 483 and final sealing of the entire unit.

The filler material 408 may be added to the cavities within the solenoid actuated safety valve shown in FIGS. 6A–6D within a vacuum chamber in order to prevent air bubbles from becoming trapped within the filler. This further enhances the effectiveness of the filler material 408 in totally sealing the solenoid and any associated electrical components within the system.

The electrically insulative filler encapsulation method and the structure of the solenoid actuated safety valve of this embodiment of the present invention possesses a number of unique advantages over prior art solenoid actuated safety valves.

Employing the filler encapsulation technique eliminates the need for structural sealing of the annular chamber which receives the solenoid coil 415 and the wires 416 and 417, i.e., the assembled machined parts no longer have to be fluid tight. For example, use of the filler 408 and the associated valve structure eliminates two sets of o-rings and machined grooves which are contained within the related configuration of a solenoid operated safety valve discussed above in connection with FIGS. 3A–3D. That is, the filler material 408, rather than expensive fluid pressure barriers, serve to protect the electrical wires and the solenoid coil 415 from well fluids. This structural configuration also allows the anti-rotation adjustment tube 455 and the coil tube 471 to have relatively thin wall thicknesses which do not serve as load or pressure bearing members. This reduction of the thickness of the coil tube 471 also greatly improves the magnetic coupling between the armature section 433 of the operator tube 430 and the solenoid coil 415. Reducing the thickness of the cylindrical coil tube 471 also allows for an increased inside diameter flow area of the passageway 446 for the same outside diameter of the housing 440 or, saying the same thing another way, it allows a smaller outside diameter of the overall housing 440 for the same diameter of inside flow area of the passageway 446.

It is thus believed that the operation and construction of the present invention will be apparent from the foregoing description. While the method, apparatus and system shown and described has been characterized as being preferred it will be obvious that various changes and modifications may be made therein without departing from the spirit aND the scope of the invention as defined in the following claims.

What is claimed is:

1. An electrically operated solenoid actuated safety valve system for use in a borehole, comprising:

an elongate tubular safety valve housing assembly having one end adapted for attachment to the lower end of a tubing string within the borehole, and the other end adapted to control the entry of borehole fluids into the assembly, said housing assembly including an outer housing, an inner wall defining a tubular passageway for allowing fluid flow through the valve assembly, and an annular space therebetween;

a tubular magnetic armature member having a lower end adapted for engaging a valve closure member to effect opening of the valve, said member being mounted for axial movement within the tubular passageway through said housing assembly from a spring biased upper retracted position disengaged from said closure member and closing said valve to a lower extended position engaged with said closure member and opening said valve;

a tubular electrical solenoid coil positioned in the annular space between the outer housing and the inner wall of said housing assembly and, at an axial location below the upper retracted position of said magnetic armature, the opposite ends of the wire coil comprising said solenoid extending through the annular space toward the end of the housing assembly adapted to be connected to the tubing;

means for connecting said wire ends to an electrical cable extending from the surface of the borehole to enable current to flow through the solenoid coil and cause movement of the tubular armature member of said valve toward its lower extended position and effect opening of the valve; and an electrically insulative filler material filling the annular space in substantially all regions thereof not occupied by said solenoid coil and wires to prevent the entry of borehole fluids into said annular space.

2. An electrically operated solenoid actuated safety valve system as set forth in claim 1, wherein said electrically insulative filler material comprises an epoxy resin.

3. An electrically operated solenoid actuated valve safety system as set forth in claim 1 which also includes means for applying a first higher value of current to the electrical cable extending from the surface to the solenoid coil to effect downward movement of the tubular magnetic armature member and a second lower value of current to the solenoid coil to hold the armature in its lower position with the valve open once actuation has been effected.

4. An electrically operated solenoid actuated valve safety system as set forth in claim 1 wherein said tubular magnetic armature member includes an elongate operator tube having a cylindrical armature portion formed of highly magnetic material and the safety valve housing assembly also includes a magnetic stop located near the lower end of the armature portion when the operator tube is in its lower position to effect the allowance of holding of the armature in the lower position at a lower value of current through the solenoid coil.

5. An electrically operated solenoid actuated safety valve system as set forth in claim 1, which also includes a programmable current source connected to the electrical cable extending from the surface to the solenoid coil for supplying preselected values of electric current to said solenoid coil.

6. An electrically operated solenoid actuated safety valve system as set forth in claim 5, wherein said elongate operator tube comprises:

an upper cylindrical tube section having relatively thin walls and being formed of relatively less magnetic material;

a lower cylindrical tube section having relatively thin walls and being formed of relatively less magnetic material; and a central cylindrical tubular armature portion coaxially connected between said upper and said lower sections and being formed of highly magnetic material, said armature portion being located near the upper end of said solenoid coil for downward movement in response to current flow through said solenoid.

7. An electrically operated solenoid actuated safety valve system as set forth in claim 6 which also includes:

a helical spring surrounding said operator tube for spring biasing said tube toward its upper position;

8. An electrically operated solenoid actuated safety valve system as set forth in claim 7 which also includes:

a cylindrical magnetic stop formed of highly magnetic material mounted to the lower end of said coil tube adjacent the lower end of said solenoid coil surrounding the lower cylindrical section of said operator tube and having upper edges being spaced by an air from the lower edges of the armature portion of the operator tube when said tube is located in its lower position in response to current flow through said coil, said magnetic stop serving to retain said operator tube in its lower position by means of a lower value of current flow through the coil than that required to initially move the tube from its upper to its lower position against its spring bias.

9. An electrically operated solenoid actuated safety valve system as set forth in claim 7 wherein said operator tube also includes a lowest cylindrical tube section having relatively thin walls and being formed of relatively less magnetic material and coaxially connected to the end of said lower section by a radially extending junction flange which abuts the upper end of said helical spring for upwardly biasing said operator tube.

10. An electrically operated solenoid actuated safety valve system as set forth in claim 1 wherein said electrically insulative filler material also protects the components it surrounds from borehole pressures.

11. An electrically operated solenoid actuated safety valve system as set forth in claim 11 wherein the filler material is a high tear strength silicone elastomer.

12. An electrically operated solenoid actuated safety valve system for use in a borehole, comprising:

an elongate tubular safety valve housing assembly having one end adapted for attachment to the lower end of a tubing string within the borehole, and the other end adapted to control the entry of borehole fluids into the assembly, said housing assembly including an outer housing, an inner wall defining a tubular passageway for allowing fluid flow through the valve assembly, and an annular space therebetween;

a tubular magnetic armature mounted for axial movement within the tubular passageway through said housing assembly from a spring biased upper retracted position closing said valve to a lower extended position opening said valve;

a tubular electrical solenoid soil positioned in the annular space between the outer housing and the inner wall of said housing assembly and at an axial location below the upper retracted position of said armature, the opposite ends of the wire coil comprising said solenoid extending through the annular space toward the end of the housing assembly adapted to be connected to the tubing, said solenoid coil being wound upon a cylindrical coil tube the inside surface of which comprises a portion of the inner wall defining the tubular passageway through the elongate housing assembly, said coil tube being formed of non-magnetic material having relatively thin walls to increase the degree of magnetic coupling between the solenoid coil and the tubular magnetic armature;

means for connecting said wire ends to an electrical cable extending from the surface of the borehole to enable current to flow through the solenoid coil and cause movement of the tubular armature of said valve toward its lower extended position and effect opening of the valve; and an electrically insulative filler material filling the annular space in substantially all regions thereof not occupied by said solenoid coil and wires to prevent the entry of borehole fluids into said annular space.

13. An electrically operated solenoid actuated safety valve system as set forth in claim 12 wherein said elongate housing assembly also includes a cylindrical anti-rotation adjustment tube threadedly coupled to the upper end of said coil tube for adjustment of the length thereof in the longitudinal direction to secure a snug fit within a recess in the inner wall of the outer housing.

14. An electrically operated solenoid actuated safety valve system for use in a borehole, comprising: an elongate tubular safety valve housing assembly having one end adapted for attachment to the lower end of a tubing string within the borehole, and the other end adapted to control the entry of borehole fluids into the assembly, said housing assembly including an outer housing, an inner wall defining a tubular passageway for allowing fluid flow through the valve assembly, and an annular space therebetween, said elongate housing assembly also including:

a cylindrical outer housing having relatively thick walls for resisting borehole pressures and forces;

a cylindrical coil tube having relatively thin walls and an outer diameter less than the inner diameter of the outer housing to form said annular space therebetween, the inner walls of said coil tube receiving said elongate operator tube for coaxial movement therein;

a tubular magnetic armature mounted for axial movement within the tubular passageway through said housing assembly from a spring biased upper retracted position closing said valve to a lower extended position opening said valve;

a tubular electrical solenoid coil positioned in the annular space between the outer housing and the inner wall of said housing assembly and, at an axial location below the upper retracted position of said armature, the opposite ends of the wire coil comprising said solenoid extending through the annular space toward the end of the housing assembly adapted to be connected to the tubing, said solenoid coil being wound upon the outer surface of said coil tube;

means for connecting said wire ends to an electrical cable extending from the surface of the borehole to enable current to flow through the solenoid coil and cause movement of the tubular armature of said valve toward its lower extended position and effect opening of the valve; and an electrically insulative filler material filling the annular space in substantially all regions thereof not occupied by said solenoid coil and wires to prevent the entry of borehole fluids into said annular space.

15. A solenoid operated safety valve for use in a petroleum production well having fluid production tubing extending down a borehole, wherein said solenoid actuated valve includes:

an elongate housing assembly having a central passageway therethrough and an annular cavity located between the outside wall of said housing and the inside wall defining the passageway;

means for connecting the upper end of said housing to the lower end of the tubing for fluid communication between the tubing and the passageway;

a normally closed valve flapper mounted to the lower end of said elongate housing and extending across the lower end of the passageway to prevent the flow of fluids from within the borehole into the passageway;

a solenoid energization coil mounted within the annular cavity located in the sidewalls of said elongate housing and surrounding the passageway;

an elongate operator tube formed of magnetic material coaxially mounted for limited longitudinal movement in the downward direction within the passageway through said housing in response to magnetic forces produced by said solenoid coil, said operator tube having an longitudinal opening to permit the flow of fluids therethrough and having the lower end thereof positioned adjacent the normally closed valve flapper to open said valve upon downward movement of said operator tube;

means for electrically connecting the ends of the wire coil forming said solenoid energization coil to a source of electrical potential to complete the electrical circuit for energizing said solenoid coil and moving said operator tube in the downward direction to open the valve; and an electrically insulative filler material surrounding said solenoid coil and filling the open space within the annular cavity located in the sidewalls of said housing to insulate the electrical components of said solenoid coil from borehole fluids.

16. A solenoid operated safety valve as set forth in claim 15, wherein said electrically insulative filler material comprises an epoxy resin.

17. A solenoid operated safety valve as set forth in claim 15 which also includes means for applying a first higher value of current to the electrical coil to effect downward movement of said operator tue and a second lower value of current to the solenoid coil to hold said operator tube in its lower position with the flapper valve open once actuation has been effected.

18. A solenoid operated safety valve as set forth in claim 15 wherein said elongate operator tube includes a cylindrical armature portion formed of highly magnetic material and said housing assembly also includes a magnetic stop located near the lower end of the armature portion when the operator tube is in its lower position to effect the allowance of holding of the armature in the lower position at a lower value of current through the solenoid coil.

19. A solenoid operated safety valve as set forth in claim 15, which also includes a programmable current source for supplying preselected values of electric current to said solenoid coil.

20. A solenoid operated safety valve as set forth in claim 18, wherein said elongate operator tube comprises:

an upper cylindrical tube section having relatively thin walls and being formed of relatively less magnetic material;

a lower cylindrical tube section having relatively thin walls and being formed of relatively less magnetic material; and a central cylindrical tubular armature portion coaxially connected between said upper and said lower sections and being formed of highly magnetic material, said armature portion being located near the upper end of said solenoid coil for downward movement in response to current flow through said solenoid.

21. A solenoid operated safety valve as set forth in claim 20 which also includes:

a helical spring surrounding said operator tube for spring biasing said tube toward its upper position.

22. An electrical solenoid actuated safety system as set forth in claim 21 which also includes:

a cylindrical magnetic stop formed of highly magnetic material mounted to the lower end of said coil tube adjacent the lower end of said solenoid coil surrounding the lower cylindrical section of said operator tube and having upper edges being spaced by an air gap from the lower edges of the armature portion of the operator tube when said tube is located in its lower position in response to current flow through said coil, said magnetic stop serving to retain said operator tube in its lower position by means of a lower value of current flow through the coil than that required to initially move the tube from its upper to its lower position against its spring bias.

23. A solenoid operated safety valve as set forth in claim 21 wherein said operator tube also includes a lowest cylindrical tube section having relatively thin walls and being formed of relatively less magnetic material and coaxially connected to the end of said lower section by a radially extending junction flange which abuts the upper end of said helical spring for upwardly biasing said operator tube.

24. A solenoid operated safety valve as set forth in claim 15 wherein said electrically insulative filler material also protects the components it surrounds from borehole pressures.

25. A solenoid operated safety valve as set forth in claim 24 wherein the filler material is a high tear strength silicone elastomer.

26. A solenoid operated safety valve for use in a petroleum production well having fluid production tubing extending down a borehole, wherein the solenoid actuated valve includes:

an elongate housing assembly having a central passageway therethrough and an annular cavity located between the outside wall of said housing and the inside wall defining the passageway;

means for connecting the upper end of said housing to the lower end of the tubing for fluid communication between the tubing and the passageway;

a normally closed valve flapper mounted to the lower end of said elongate housing and extending across the lower end of the passageway to prevent the flow to fluids for within the borehole into the passageway;

a solenoid energization coil mounted within the annular cavity located in the sidewalls of said elongate housing and surrounding the passageway, said solenoid energization coil being wound upon a cylindrical coil tube the inside surface of which comprises a portion of the inner wall defining the tubular passageway through the elongate housing assembly, said coil tube being formed of non-magnetic material having relatively thin walls to increase the degree of magnetic coupling between the solenoid coil and the tubular magnetic armature;

an elongate operator tube formed of magnetic material coaxially mounted for limited longitudinal movement in the downward direction within the passageway through said housing in responses to magnetic forces produced by said solenoid coil, said operator tube having an longitudinal opening to permit the flow of fluids therethrough and having the lower end thereof positioned adjacent the normally closed valve flapper to open said valve upon downward movement of the said operator tube;

means for electrically connecting the ends of the wire coil forming said solenoid energization coil to a source of electrical potential to complete the electrical circuit for energizing said solenoid coil and moving said operator tube in the downward direction to open the valve; and an electrically insulative filler material surrounding said solenoid coil and filling the open space within the annular cavity located in the sidewalls of said housing to insulate the electrical components of said solenoid coil from borehole fluids.

27. A solenoid operated safety valve as set forth in claim 26 wherein said elongate housing assembly also includes a cylindrical anti-rotation adjustment tube threadedly coupled to the upper end of said coil tube for adjustment of the length thereof in the longitudinal direction to secure a snug fit within a recess in the inner wall of the outer housing.

28. A solenoid operated safety valve for use in a petroleum production well having fluid production tubing extending down a borehole, wherein the solenoid actuated valve includes an elongate housing assembly having a central passageway therethrough and an annular cavity located between the outside wall of said housing and the inside wall defining the passageway; said elongate housing assembly including:

a cylindrical outer housing having relatively thick walls for resisting borehole pressures and forces;

a cylindrical coil tube having relatively thin walls and an outer diameter less than the inner diameter of the outer housing to form said annular space therebetween, the inner walls of said coil tube receiving said elongate operator tube for coaxial movement therein;

means for connecting the upper end of said housing to the lower end of the tubing for fluid communicating between the tubing and the passageway;

a normally closed valve flapper mounted to the lower end of said elongate housing and extending across the lower end of the passageway to prevent the flow of fluids from within the borehole into the passageway;

a solenoid energization coil mounted within the annular cavity located in the sidewalls of said elongate housing and surrounding the passageway, said solenoid energization coil being wound upon the outer surface of said coil tube;

an elongate operator tube formed of magnetic material coaxially mounted for limited longitudinal movement in the downward direction within the passageway through said housing in response to magnetic forces produced by said solenoid coil, said operator tube having an longitudinal opening to permit the flow of fluids therethrough and having the lower end thereof positioned adjacent the normally closed valve flapper to open said valve upon downward movement of said operator tube;

means for electrically connecting the ends of the wire coil forming said solenoid energization coil to a source of electrical potential to complete the electrical circuit for energizing said solenoid coil and moving said operator tube in the downward direction to open the valve; and an electrically insulative filler material surrounding said solenoid coil and filling the open space within the annular cavity located in the sidewalls of said housing to insulate the electrical components of said solenoid coil from borehole fluids.

* * * * *